US007997824B2

(12) United States Patent
Amengual Pericas

(10) Patent No.: US 7,997,824 B2
(45) Date of Patent: Aug. 16, 2011

(54) COMBINED ROAD SAFETY BARRIER MADE FROM WOOD AND METAL, INTENDED FOR VEHICLE LATERAL IMPACT CONTAINMENT AND HAVING AESTHETIC QUALITIES AND CONTAINMENT AND REDIRECTION CAPABILITY

(75) Inventor: Antonio Amengual Pericas, Asturias (ES)

(73) Assignee: Hierros y Aplanaciones, S.A., Asturias (ES)

( * ) Notice: Subject to any disclaimer, the term of this patent is extended or adjusted under 35 U.S.C. 154(b) by 0 days.

(21) Appl. No.: 12/523,722

(22) PCT Filed: Oct. 9, 2007

(86) PCT No.: PCT/ES2007/000573

§ 371 (c)(1), (2), (4) Date: Jul. 17, 2009

(87) PCT Pub. No.: WO2008/087232

PCT Pub. Date: Jul. 24, 2008

(65) Prior Publication Data

US 2010/0008722 A1 Jan. 14, 2010

(30) Foreign Application Priority Data

Jan. 19, 2007 (ES) ..... 200700165

(51) Int. Cl.
*E01F 15/00* (2006.01)

(52) U.S. Cl. ..... 404/6; 256/13.1

(58) Field of Classification Search ..... 404/6, 9; 256/1, 13.1

See application file for complete search history.

(56) References Cited

U.S. PATENT DOCUMENTS 4,946,138 A * 8/1990 Gaillard et al. ..... 256/13.1
7,604,221 B2 * 10/2009 Lass et al. ..... 256/13.1

FOREIGN PATENT DOCUMENTS

DE 19601377 A1 * 1/1996
FR EP 0184525 * 11/1985
WO WO 03083220 * 3/2003

OTHER PUBLICATIONS

WIPO, International Search Report for International Application No. PCT/ES2007/000573.

* cited by examiner

*Primary Examiner* — Raymond W Addie

(74) *Attorney, Agent, or Firm* — Intellectual Property Law Group LLP; Juneko Jackson

(57) ABSTRACT

Contention system for lateral impacts from vehicles, of the kind formed from a mixed metal and wooden horizontal continuous rail, comprising two or more wooden logs of equal cross-section, preferably rectangular, fitted with the same metal profile of cross-section preferably in the form of a "sigma" and longitudinally connected together by means of a metal plate, with the rail being supported at regular intervals by metal uprights inserted or secured into the ground, externally faced with a wooden cover consisting of three or more flat wooden strips, the rail being fixed to the posts by means of a metal distancer spacer by way of support, formed from a main piece in the form of an "omega" lying on its side which joins consecutive rails together via their ends and an interior U-piece which incorporates the star-shaped hole for the breakaway attachment between the support and the post, with a metal support plate between the front part of the wooden cover for the post and the central part of the metal support.

6 Claims, 18 Drawing Sheets

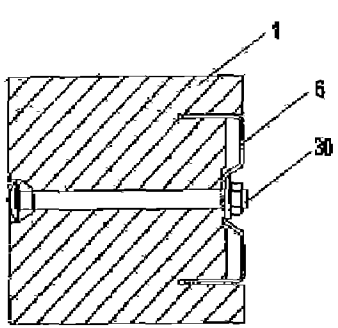
FIG.14a
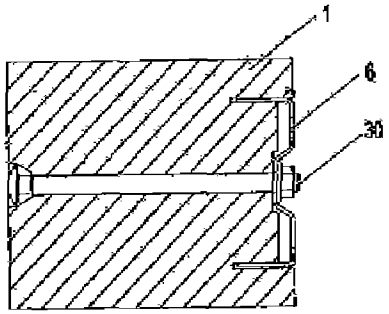
FIG.14b
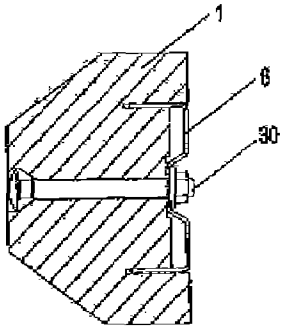
FIG.14c
FIG.14d
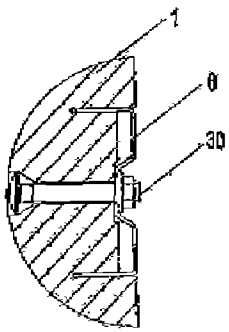
FIG.14e
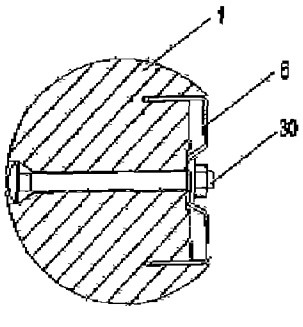
FIG.14f
FIG.14

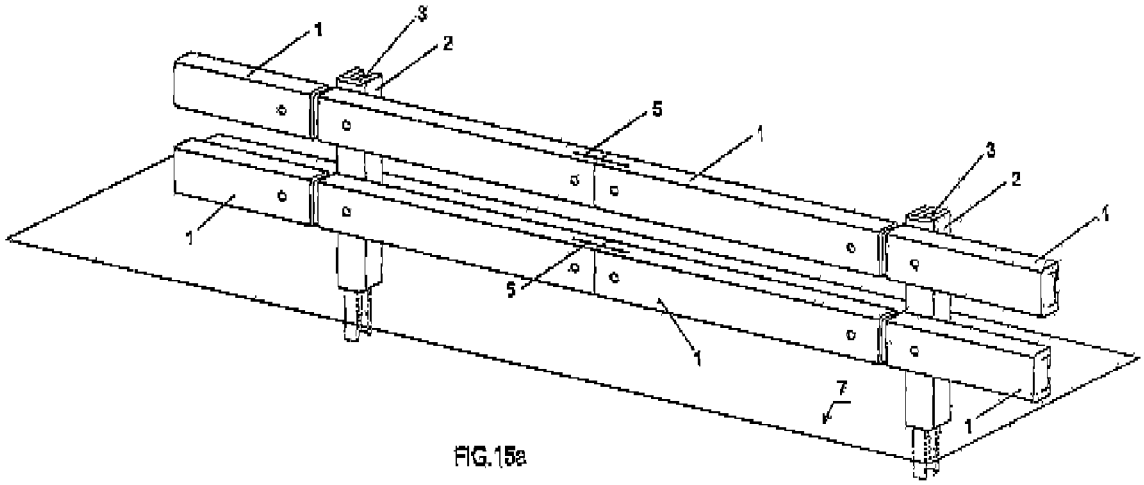
FIG.15a
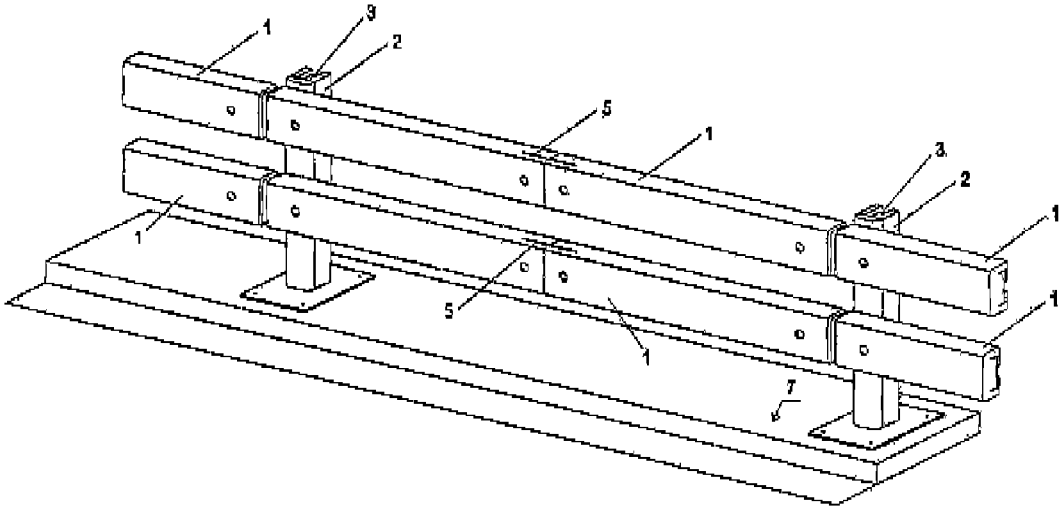
FIG.15b
FIG.15

COMBINED ROAD SAFETY BARRIER MADE FROM WOOD AND METAL, INTENDED FOR VEHICLE LATERAL IMPACT CONTAINMENT AND HAVING AESTHETIC QUALITIES AND CONTAINMENT AND REDIRECTION CAPABILITY

OBJECT OF THE INVENTION

This invention relates to a system for containing lateral impacts from vehicles, with capacity for retention and redirection, comprising metal and wooden pieces combined in such a way that the unit presents aesthetic qualities for merging with the landscape, for use in road safety, such as safety guardrails and parapets, having application for the sides and central reservations of roads.

STATE OF THE ART

There exist in practice different types of vehicle contention systems, these being understood as being any device installed on the sides or in the central reservation of roads with the aim of providing retention and redirection for a vehicle which comes off the road out of control, thereby reducing the severity of accidents produced, in such a way that the damages and injuries are limited both for the occupants and for other road-users or objects located in the vicinity.

Safety guardrails and parapets are made up of a series of components which, overall, and once they have been assembled and inserted into the ground or secured to a concrete slab, have the aim of resisting vehicle impacts, preventing vehicles from passing through them and thus guaranteeing the protection of third parties, and at the same time carrying out a controlled redirection and deceleration in such a way that the vehicle comes out of the impact stably and continues along its path at a reduced speed alongside the contention system in the original direction of the traffic, and in this way guarantees the safety of the occupants of the vehicle and that of other road-users.

Within contention systems as a whole, some of the commercially most habitual ones are metal safety guardrails and concrete safety guardrails. However, in certain areas such as mountain roads, nature parks, beaches, zones of touristic interest, etc., metal and concrete safety guardrails can cause an ambient visual impact that is somewhat "aggressive" and undesired and, in general, they do not easily merge into a natural setting. In these cases, therefore, what are known as "aesthetic" guardrails are installed, these being all those which, on account of their specific qualities of design and composition, are able to merge visually in a pleasing way into a natural setting, in a manner that is low-key and coherent with the setting.

As an example of aesthetic guardrails, we have two fundamental types:

Stone Walls, which can consist of dry stone or be masonry or concrete walls externally finished in stone, or even concrete walls with printed and coloured surface geometries.

Wooden Guardrails, which can be (i) guardrails made of solid wood in which both the rails and the insertion or securing posts are solid wooden pieces, or (ii) wooden guardrails made of pieces that are internally or externally reinforced with metal elements or pieces with an external finish of wood, these latter being known as mixed metal and wooden guardrails. The only aesthetic wooden guardrails that have so far been shown to have full capacity for contention and redirection in the event of vehicle impact in accordance with the performance requirements demanded of guardrails by means of test crash procedures at the real scale, such as European norm EN 1317-2 and report NCHRP 350 of the USA, are the type known as mixed guardrails.

Mixed metal wooden safety guardrails usually correspond to the union by assembly of three basic metal elements:

1.—The rail(s), longitudinal element(s) arranged horizontally at a certain height and continuously, the role of which is to contain and guide the vehicle impacting it, preventing it from passing through, limiting the transverse deformation and guiding it in such a way that it can be redirected by the system in an appropriate manner. The rail always consists of a wooden bar or beam, simple or composite, reinforced with one or several metal profiles that are internal, external or partially inserted in the wooden beam. The wooden beam or log can have different geometries and designs: in the form of a complete round log, a half-round log, with quadrangular or rectangular or polygonal cross-section or other more complex forms. The metal reinforcing profile can be a flat or curved plate, interior or exterior, or it can be a U-shaped metal profile with its arms wholly or partially inserted in the wooden beam, or a C-shaped metal profile occupying an interior hollow in the wooden beam or stuck externally to it.

2.—The post, formed from a metal profile with a cross-section in the form of a "U", "C", "sigma" or round tubular, quadrangular or rectangular cross-section, partially covered in its part emerging from the ground with a single-piece wooden cover, arranged vertically at regular intervals and fixed to the rail(s), and having the task of sustaining and maintaining the rail(s) of the guardrail at a certain height during the impact and, moreover, it is also the element for insertion or securing of the guardrail in the ground.

When the post is inserted or embedded directly in soils, which is what occurs with a large part of road margins in embankments and central reservations, part of the metal profile is sunk into the ground and it transmits the stresses of the impact from the rail to the surrounding ground, and the emerging part of that metal profile is externally covered, either wholly or partially, with a wooden piece acting as a cover.

When the post is secured to a concrete slab or is embedded in rocky ground, the lower part of the post is provided with a baseplate having a set of holes so that anchor bolts can pass through them to the ground and, again, the emerging part of that metal profile is externally covered, either wholly or partially, with a wooden piece acting as a cover.

3.—The spacer, which has the task on the one hand of attaching the consecutive rails together in order to provide them with continuity longitudinally, and on the other of attaching the rails to the securing posts and to possibly acting as a deformable element, in other words, as an attenuator or absorber of part of the energy of the impact or simply as a rigid-spacing element in order to prevent the wheel of the vehicle being becoming caught in the post and maintaining the height of the rail during the impact as the post starts to bend and, with it, the point of attachment between it and the support descends, as well as contributing towards redirecting the vehicle during the impact. On some occasions, this element consists of metal pieces or profiles shaped in a way that is to some degree complex, or it consists of tubular profiles with a square or rectangular cross-section, open or closed, and it can include wooden elements. On other occasions we can find guardrails in which there is no spacer, and the rails are secured to each other and to the post by means of a simple flat metal piece. In both one case and the other, the attachment of the metal piece or spacer with the post can be of the breakaway kind.

The behaviour towards impact by a vehicle of a safety guardrail of the kind consisting of continuous horizontal rails secured by vertical posts sunk into the ground at regular intervals, with the mediation of rigid spacers or distancers, can be synthetically described as follows:

During impact from the vehicle against the guardrail, the side of the vehicle makes contact with the front face of the rail which is the element of the guardrail that receives the impact, it transmits it and propagates it along a stretch of guardrail and guides the vehicle towards the exit. If the position of the rail descends in height as a consequence of contact with the vehicle, the difference in heights between the centre of gravity of the vehicle and the rail can cause the vehicle to destabilise and overturn, and even breach the guardrail.

The typical collision of a vehicle against a safety guardrail consisting of horizontal rails secured in vertical posts at regular intervals, which are inserted or secured in the ground, is a complex dynamic phenomenon which, if the guardrail is properly designed in order to guarantee the contention and redirection of the vehicle, has to take place in a controlled way. When the front side of the vehicle impacts against the guardrail, it makes an initial contact with the rail and, as this primary contact is made in front of the centre of gravity of the vehicle, the reaction of the guardrail imposes a rotary movement on the vehicle in the direction of redirection. During the process of redirection, the vehicle is displaced and rotates at the same time, and it has to maintain a continuous and stable contact with the rail without reaching the point of impacting against the posts, until the rear side again hits the rail. Since this secondary impact is produced behind the centre of gravity of the vehicle, a rotation is produced in it in the direction opposite to that of the redirecting rotation, putting an end to the redirection and causing the vehicle to exit, once it has lost contact with the rail. The relation between the degree of elasticity of the first and second collisions will determine the exit trajectory of the vehicle and define the redirection capacity of the guardrail, as well as having a notable influence on the maximum transverse deformation of that guardrail.

The post responds to the forces transmitted by the rail and originated by the impact of the vehicle, becoming progressively deformed due to bending and twisting, becoming bent around its foundation so that its upper part or head descends down towards the ground. If the rail remains fixed to the head of the post, a moment will be reached when the ratio of heights between the rail in contact with the vehicle and its centre of gravity become imbalanced in favour of the latter, the rail remains low down or folded on the ground and the vehicle becomes destabilised and turns over or breaches the guardrail. For this reason, safety guardrails comprising rails and posts have a breakaway mechanism at the attachment between the support and the post in such a manner that, starting from a certain force transmitted to the attachment corresponding to a certain degree of deformation of the post, this attachment becomes decoupled, separating the rail-support unit from the post. With it, a dual benefit is obtained:

a).—On the one hand, the rail is prevented from descending.

b).—On the other, once the post has yielded and become decoupled from the rail, the latter transmits the deforming stresses to the adjacent posts so that, when the deformation capacity of the following post also becomes exhausted it too will decouple by means of the breakaway mechanism and so on successively, in such a way that the deformation is propagated along a stretch of guardrail as far as the exit of the vehicle.

During and after impact against a guardrail, the stability of the vehicle is fundamental for satisfactory control over it. In that stability, as we have seen, the two fundamental factors are:

The height of the rail has to be maintained so that the vehicle does not overturn or breach the rail on account of the ratio of its height with the centre of gravity of the vehicle.

The breakaway mechanism has to be triggered at the right moment, when the post has exhausted its contribution to the deformation and redirection of the guardrail unit and it has to do this reliably, with a high degree of repeatability.

The problems presented by current systems of mixed wooden and metal safety guardrails are:

(i).—Wooden rails internally reinforced with metal manufactured from a single piece are too rigid during a collision, they have a low degree of flexibility, they deform very little and their contact with the metal sheet of the vehicle body impacting laterally against the guardrail is very aggressive, causing splinters of wood and pieces of the vehicle bodywork to become detached. This "rigid" characteristic of contact between vehicle and rail prejudices the stability of the vehicle and Increases the severity of the injuries and damage.

(ii).—The wooden pieces of rails made of a single piece in guardrails in which the distance between consecutive posts is greater than three metres are very expensive since they have to be obtained from parts that are very straight and healthy coming from long trunks and, on top of that, long wooden rails made of a single piece present warping problems during the natural process of drying the wood. This warping causes deformation of the metal to reinforcing them internally or externally.

(iii).—The spacers, both those acting as absorbers and simple distancers, also function as longitudinal connectors between two consecutive rails, which means they have to guarantee the rigidity of the attachments between consecutive rails, in such a way that no relative torsions or rotations between them take place and the stresses and deformations originated by the impact of a vehicle against the guardrail can be transmitted along several consecutive rails without discontinuity, as if the successive stretches of rail were a single continuous stretch and become deformed coherently adopting the form of a curve when seen in plan view. The spacers used currently provide a kind of connection between rails that is insufficient for guaranteeing the almost complete torsional and rotational "blocking" of the attachment between two consecutive rails.

(iv).—The need to provide a decoupling separation between the spacer and the post when the latter has become deformed too much, in order to prevent the post from descending down to the ground pulling the rail down with it, reducing its height and thereby making it easier for the vehicle to breach the rail or become destabilised, requires a very controlled and reliable breakaway mechanism which right now is difficult to achieve with current spacers.

(v).—The inevitable deformation of the metal post during impact from a vehicle against the guardrail produces breakage into pieces of the wooden cover lining the outside and the uncontrolled detachment of those pieces or of the whole wooden cover, which is currently manufactured in a single piece or, at most, with a second closing piece. Wooden pieces of a certain size and shape, becoming detached and projecting at a certain speed and height, can represent a serious danger for traffic. Moreover, single-piece wooden covers are more expensive to manufacture and, as they dry out due to exposure to the weather, they become deformed and the sides (the part of the cover surrounding the cavity housing the metal post) open up in the form of wings pointing outwards, detracting from the aesthetic qualities of the guardrail.

(vi).—The end sections of stretches of mixed wooden and metal safety guardrails are executed by means of folding the rail down towards ground level, burying its end and then securing the section of folded rail by means of various posts inserted or secured into the ground with the aim of the end section acting as an anchorage for that stretch of guardrail. If the end section is not long enough when it is folded or it does not have a large number of posts, which is what usually happens due to lack of space on roads where this type of guardrail is required, then the probable breakage of the ground at the buried end due to forces originated by the impact of a vehicle a short distance away being transmitted that far can cause the attachment between the posts and the folded rail to break and, with it, breakage of the end anchorage. When this happens, the rail loses all its tension and the guardrail ceases to function as a longitudinal contention element.

DESCRIPTION OF THE INVENTION

The present invention provides a System for contention of lateral impacts from vehicles comprising metal and wooden pieces, with aesthetic qualities and with high capacity for contention and redirection which, simultaneously, has the following advantageous technical characteristics with respect to the State of the Art, where the problems presented by the latter have been overcome:

(i) high and controlled capacity for absorption of the energy resulting from the impact of a vehicle, in order to provide the contention system with an elasto-plastic behaviour and thereby reduce its rigidity along with the detachment of pieces of the guardrail, in order to prevent the contention system from causing equivalent or worse injuries than those it is sought to protect road-users from;

(ii) high capacity to reduce the levels of decelerations produced in a light vehicle during the impact, in order to diminish the severity of the impact and thereby the risk of injuries to the occupants of the vehicle;

(iii) high capacity for control over the vehicle during and after the collision, maintaining it stable on its wheels and thus reducing the possibility of later undesired reactions of it (rotations, turning over, unexpected trajectories, etc.) and achieving an exit trajectory that is as parallel as possible to the contention system, thus reducing the risk of secondary collisions of the vehicle with other road-users;

(iv) high capacity for controlling the dissipation of the absorbed energy, in order to grant the contention system a certain ability to deform itself similarly following each impact from a vehicle, and so contribute towards extending the useful life of the rest of the elements constituting the contention system;

(v) capacity to transmit to the ground the forces originated as a consequence of a vehicle, by means of the end anchorages, preventing them from breaking with the loss of tension of the guardrail.

To achieve this, and with the aim of obtaining the above advantages with respect to the State of the Art, it has been necessary to design a new system for contention of lateral impacts from vehicles, with aesthetic qualities, of the mixed wooden and metal type guardrail, which incorporates the following characteristics as novelties, which are developed more fully below:

(I).—The rails of the mixed metal and wooden guardrail consist of two or more wooden logs, granting the rail a certain capacity for deformation, lowering the manufacturing cost and reducing the risk of warping.

(II).—A new kind of distancer spacer by means of a support which guarantees the continuity of the rail due to notably reducing the relative rotations and torsions between two consecutive rails.

(III).—A new breakaway mechanism for the attachment between the support and the post of the guardrail which functions in a way that is more controlled and reliable.

(IV).—A wooden cover for the metal post supporting the guardrail which is composed of three or more wooden strips assembled together.

(V).—A metal support plate located between the spacer or support and the front face of the wooden cover.

(VI).—An additional metal plate located at the end of the guardrail.

(I).—the rails of the mixed metal and wooden guardrail consist of two or more wooden logs, of identical cross-section, preferably rectangular with their larger sides arranged vertically, or square, polygonal, circular or semi-circular, assembled on a single metal profile which internally reinforces the rail, with the wooden logs being joined to it by suitable means of securing and adjacent logs forming the same rail being connected longitudinally, one with another, by means of metal connection plates arranged vertically and inserted in vertical slots provided for the purpose in the ends of the wooden logs, by suitable means of securing.

This new design of rail with various logs connected by metal plates and a single metal reinforcing profile presents three advantages:

a).—it confers on the rail a certain capacity to deform under bending, taking advantage of the straight sections between every two adjacent logs of the same rail (sections of rail which lack wood) as "false joints". This small flexibility of the rail, which would otherwise behave as a completely rigid rail, leads to an improvement in the deformed line of the rail during contact with the vehicle because a deformation is achieved that is more of a curve and less "polygonalised" and with it, an improvement in the contact with the vehicle during impact, increasing the stability of the vehicle, improving the exit conditions and notably reducing the phenomenon of splintering of the wood and tearing out of bits of bodywork from the side of the vehicle. This behaviour improves when the vehicle-rail contact surface is flat and wide, so the use of rails with rectangular cross-section with the larger side vertical and one of them towards the traffic is more recommendable than other cross-sections such as rectangular with the lesser side vertical, or square, circular or semi-circular.

This slightly flexible behaviour of the rail towards dynamic impact from a vehicle has to be accompanied by the use of a metal profile of adequate cross-section, in such a way that the latter is not too rigid (which would completely block the deformation capacity in the "jointed" sections between logs) but which is sufficiently rigid for guaranteeing the degree of reinforcement required for the rail and, with it, its capacity for contention. In this regard, the use of a metal profile for interior reinforcement, penetrating the log from the rear part, with a "sigma" cross-section with its central notch not too exaggerated, with arms of shorter length than the middle part and arranged horizontally oriented towards the interior of the log from the rear part of the rail and with a thin wall (e.g., thickness of between 1.5 mm and 4 mm) turns out to be very suitable.

In effect, the cross-section of the metal profile in the form of a "sigma", with thin walls, with its central part notably larger than the arms, means that it is the "notch" which provides sufficient rigidity for the desired behaviour, without any need to achieve this by means of increasing the thickness of the wall, as would occur in the case of a metal profile with a U-shaped cross-section, which would increase the costs of that profile and unnecessarily increase the rigidity of the arms.

b).—the cost of the raw material for the manufacture of wooden rails starting from trunks is less when the length of rail is less (e.g. a beam of 4 m is more expensive than two beams of 2 m). In this regard, the fragmentation of the piece of wood or log of the rail into two or more stretches implies a significant reduction in production costs.

c).—the warping effect of the rails of the mixed metal and wooden guardrail caused by drying of the constituent wood, whether natural or artificial, during storage or exposed to the weather, is notably less when the logs or wood are shorter. In this regard, the fragmentation of the log of wood longitudinally decomposed into two or more pieces gives as a result a rail without risk of warping due to drying of the wood (II).—a new kind of distancer spacer which, as well as performing all the functions proper to this component in this type of mixed guardrail (distancing the base of the post from the wheels of the vehicle during impact, maintaining the height of the rail during the deformation of the post, totally or partially incorporating the device for the breakaway attachment mechanism between rails and post, attaching the rails to the post in such a way that the latter secures them and joining consecutive rails together in order to provide longitudinal continuity to the guardrail) also offers, on account of its design, composition and connections with other components, guarantees that successive stretches of rail behave as a single continuous stretch without any relative torsions and rotations appearing between two consecutive or adjacent rails.

To achieve this advantage, the metal support is preferably designed in the form of a bar with an "omega" cross-section lying laterally, with the two flanges or feet and the central section of the "omega" being arranged vertically and the arms of the "omega" being horizontal or slightly inclined. The support is located on the guardrail, longitudinally between two consecutive or adjacent rails and transversally between them and the post, in such a way that both flanges of the support rest on the rear face of the rail and the central part of rests on the post, either directly or by means of a support plate. The flanges are provided with a set of holes, preferably aligned, for being traversed by the attachment elements, preferably screwed, between the rails and the support. In this way, two horizontal alignments are achieved of screwed attachments between the rails and the support: an upper alignment and a lower one, approximately equidistant from the longitudinal axis of the rail. In turn, each of the alignments of screwed attachments comprise attachments located in both consecutive rails. The attachment elements between consecutive rails and the support successively traverse holes or openings provided in the middle of the steel profile of the rail and the corresponding holes or openings of the flanges for the support.

These attachment screws between the rail and the support are located, preferably horizontal, in such a way that the head of the screw or bolt remains imprisoned between the inner wall of the central part of the metal profile of the rail and the wooden log of the rail, with the shaft exiting horizontally through the openings of the metal profile of the rail towards the rear part or the part away from the traffic. In this way, the screws remain imprisoned in the rail. In order to prevent the free rotation of the screw while it is being tightened, the corresponding opening in the central part of the metal profile of the rail preferably has a square shape, as does the neck of the screw, in such a way that, when the neck of the screw fits into the opening in the profile, the screw becomes not only Imprisoned but also its rotation is blocked, allowing it to be tightened.

With the aim of preventing the forces transmitted to the rail during impact causing the heads of the prisoner screws to pass through the holes or openings in the metal profile of the rail, tearing them and therefore causing consecutive rails to become decoupled and the guardrail to thus lose its continuity, a metal washer, preferably square, rectangular or circular, is located between the head of the screw and the inner wall of the metal profile of the rail, this reinforcing the area around the hole.

The metal profile preferably used to reinforce the rail has a cross-section In the shape of a "sigma", in other words, the shape that results from creating a partial notch centred in the middle of a "U", parallel to the direction of the arms of that "U" and oriented towards the opening of the "U". The position of that metal profile in the rail has the arms arranged horizontally and Inserted in the wooden log from the rear part of the rail towards the front, penetrating into individual horizontal slots made for the purpose in that log and in such a way that the central part of the "sigma" cross-section remains vertical approximately coinciding with the rear face of the wooden rail. The "sigma" cross-section of the metal profile of the rail permits attachment screws to be provided between the rails and support or prisoner screws, since the head of those screws remains imprisoned between the profile and the wooden log, in the cavities resulting from accommodating the central part of the "sigma" profile with its central notch towards the log against the flat vertical surface thereof. In order to favour the arrangement of these prisoner screws, trapped via their head between the wooden log and the metal profile of the rail, the rear face of the log can include a notch or recess, with an approximately rectangular shape, of length slightly greater than the height of the central part of the "sigma" metal profile and of depth slightly greater than the height of the central notch of the "sigma" metal profile.

Provided in the centre of the support, arranged vertically and located on the side opposite to the flanges in contact with the rear face of the rail, are means of attachment to the metal post, preferably screwed and consisting of a single screw successively traversing the central part of the support, a support plate, the front part of the wooden cover and a hole made for the purpose in the metal post.

With this new support and its fastenings to the rails and to the post described above, a rigid spacer is achieved very resistant to deformation due to bending and twisting which is solidly fastened to the rails in such a way that it prevents relative rotations and torsions between consecutive rails.

(III).—a new breakaway mechanism for the attachment between the support and the post of the guardrail which permits the rail-support unit to become decoupled from the post in a way that is controlled and reliable during impact from a vehicle, in other words, it permits the breakage of the attachment between the support and the post to be produced for a defined level of force and deformation and at the right moment, once the stresses transmitted by the rail cause the post to reach a certain level of deformation due to twisting and bending and being folded downwards, in order thereby to prevent the post from dragging the rail with it, and allowing the deformation to be transmitted to the adjacent posts, propagating it in the direction of the impact and so, as it becomes distributed along a certain length of guardrail, the system as a whole becomes capable of containing the vehicle and the resulting maximum deformation is limited to a reasonable value.

The breakaway attachment between the support and the post is achieved by means of a metal piece of cross-section preferably in the form of a "U" assembled in the interior of the support and fixed thereto, preferably by means of screwed attachments, arranged in such a way that the central part of the interior piece rests against the interior wall of the middle of the support of cross-section in the form of an "omega" lying on its side. This interior piece is provided with a hole or opening in the form of a star intended to be traversed by the head of the screw or bolt for attachment between support and post, with the head of the screw or bolt, which is preferably hexagonal, being located preferably in the interior of the support in such a way that the shaft of the screw or bolt, arranged horizontally or with a slight inclination and perpendicularly to the guardrail, successively traverses the star-shaped hole in the U-piece interior to the support, the wall of the central part of the support, the front part of the wooden cover for the post and the wall of the metal post.

In this way, we can consider that the support comprises two metal pieces: a main piece of cross-section in the form of an "omega" lying on its side and which, once the guardrail has been installed, remains in contact on one side with the rear face of the rail and on the other with the front part of the cover for the post and an interior piece of cross-section preferably in the form of a "U", "C" or a simple flat or slightly curved metal piece, the middle of which has a star-shaped hole. Once the support has been installed in the guardrail and all the attachments have finally been adjusted, the two pieces of the support are rigidly joined together in such a way that the metal support can be regarded as and functions as a single body, though consisting of two parts.

Both the interior U-piece and the main piece of the support are provided with holes in their middle for permitting them to be joined together, preferably screwed. Once the two pieces of the support have been located in the position corresponding to their final assembly, the holes in the middle of both must correspond so that the means of joining, preferably screwed, can successively traverse both pieces. The combination of counterpart holes in both pieces so that corresponding to a rounded hole in one piece is a hole in the other piece with a shape that is elongated in the longitudinal direction of the guardrail grants a certain longitudinal displacement of the U-piece inside the support with respect to the main piece of the support, which allows the longitudinal position of the rails to be adjusted with respect to the post.

The hole or opening in the central part of the interior piece of the support intended to be traversed by means of joining, preferably a screw or bolt, between the support and the post in order to form a breakaway attachment, has a special shape in the form of a star consisting of a central gap, preferably circular, oval, quadrangular or appreciably rounded, from which exit a set of narrow elongated gaps (in other words, of length more greater than their width) and arranged in a radial configuration around the central gap.

The diameter or size of the central gap of the star-shaped hole is greater than the diameter of the shaft of the screw or bolt and less than the diameter or size of the head of the screw or bolt.

The combination of the use of a screw or bolt with a preferably hexagonal head and a star-shaped hole in the central part of the interior piece of the support with a cross-section that is preferably U-shaped allows a breakaway mechanism to be created between the support and the post by means of that screw or bolt which, once tightened, and starting from a certain level of force acting on the attachment, permits the separation of the support with respect to the post, thanks to which the head of the attachment screw or bolt can pass through the star-shaped hole, bending back the metal walls located between the arms (the elongated narrow holes) of the star-shaped gap. The result is similar to a rip being made in the immediate vicinity of the star-shaped hole by the head of the screw or bolt until that head passes completely through the star-shaped hole and releases that attachment, (IV).—a wooden cover for the metal post supporting the guardrail which is composed of three or more wooden strips assembled together and, at the same time, covering all the faces of the metal post or all the faces of the metal post except the rear face away from the traffic.

The means of attachment between the different strips making up the cover for the metal post are preferably screws, bolts, spikes, nails, staples or glued surfaces and the resistance of the resulting attachments is sufficient for guaranteeing the integrity and stability of the cover unit until its final fitting in the guardrail but it is not sufficient for preventing easy breakage of the cover, which breaks up into its component strips which become detached, when the post bends as a consequence of the forces transmitted from the rail originated by the impact of a vehicle against the safety guardrail.

In this way, the pieces of wood detached from the cover during impact by a vehicle are confined to the component strips, which are of a controlled size and geometry, and so they will not constitute an additional risk for traffic, once they have become completely separated from the guardrail. If the wooden cover were to be made of a single piece, the fragmented parts would be much larger and have more aggressive shapes.

The decomposition of the cover into three or more strips covering the faces of the metal post also presents two further advantages:

The production cost of the cover is less since there is no need to carry out machining works and this avoids the wastage produced when creating the cavity housing the metal post when this is produced from single piece.

The problem is avoided that occurs with a single piece which, when the wood dries, the side arms of the cover "open" towards the outside, becoming deformed and diminishing the aesthetic quality of the guardrail.

(V).—a metal support plate located between the middle of the metal support and the front face of the wooden cover of the metal post for supporting the guardrail, with the aim of avoiding the fact that, as a consequence of the moment or couple originated by the actual weight of the rail with respect to the edge of the support having direct contact on the wooden cover and owing to the lesser hardness of the wood compared to metal, a local deformation of the wood can be produced by penetration of the lower edge of the middle of the support in the front face of the wooden cover and therefore causing the support to "sink" slightly in the cover, damaging it and affecting the alignment of the rail. The metal plate functions not just as a protective shield but also as a distributor for stresses which, if it did not exist, would be focused on the contact edge of the support with the wooden cover. Said stresses, moreover, are not sufficient for deforming the metal plate, always proved its thickness is adequate.

Without prejudice to the function described above, the metal support plate between the support and the cover can be extended down to the ground in the manner of an arm in order to sustain a screen made of metal or a plastic material, intended to protect motorcyclists and cyclists against direct impact against the posts of the guardrail or against their passing through the guardrail, which can leave their body exposed to the risks (obstacles, slopes, . . . ) that justified the positioning of the guardrail in the first place.

(VI).—an additional metal plate located at the end of the guardrail for anchoring of the stretch of guardrail, inserted into the ground via a interior surface of the metal stop in the form of a "hook" which is normally buried in that end integrally attached to the rail, said additional post not necessarily being fixed to that stop, in order thereby to prevent the ground from breaking up inside that "hook", which confers on the folded end section a greater resistance towards the forces transmitted by the stretches of rail to the end anchorage as a consequence of impact from a vehicle.

The end sections are usually constructed by folding the rail down towards the ground and burying its end attached to a metal end piece generally in the form of a "hook" and fixing the folded rail to one or more metal posts inserted or sunk into the ground and attached to the folded rail by means of metal pieces. In the event that, as a consequence of the forces transmitted along the rail as far a the end, breakage occurs of the ground inside the hook-shaped end stop, then the attachments between the posts fixed to the folded rail would have to withstand the entire tension and they would probably not be capable of doing so, in which case the stretch of rail would break and become released and be left without tension, with which the guardrail would lose its entire capacity for contention.

DESCRIPTION OF THE DRAWINGS

FIG. 6.—Lateral view in perspective of the support, from the rear side, joining two consecutive stretches of rail.

FIG. 14.—Straight sections of rails other than rectangular with the longer sides arranged vertically. FIG. 14*a* rail of square cross-section; FIG. 14*b* rail of rectangular cross-section with the shorter sides arranged vertically; FIG. 14*c* rail of polygonal cross-section; FIG. 14*d* rail of rectangular cross-section with the forward side in a midpoint; FIG. 14*e* rail of semi-round or semi-circular cross-section; FIG. 14*f* rail of round or circular cross-section.

FIG. 15.—Lateral view in perspective from the traffic side of two stretches of mixed metal and wooden guardrails with two levels of rails and several posts. FIG. 15*a* corresponds to a mixed metal and wooden guardrail with double level of rail and posts inserted in ground consisting of soil and FIG. 15*b* corresponds to a mixed parapet of metal and wood with a double level of rails and posts anchored to a concrete slab.

DESCRIPTION OF THE PREFERRED FORM OF EMBODIMENT OF THE INVENTION

Figure 1:
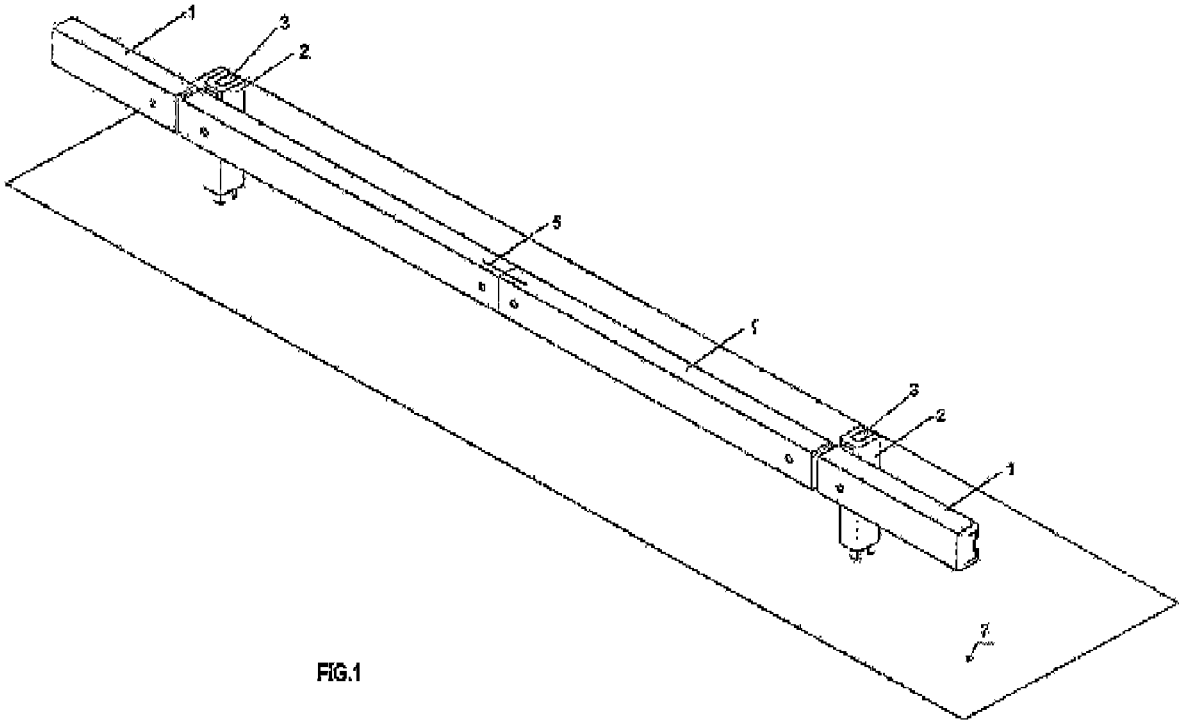
FIG. 1.—Corresponds to a lateral view in perspective of a stretch of mixed metal and wooden guardrail with several rails and posts, from the front side or traffic side.
Figure 2:
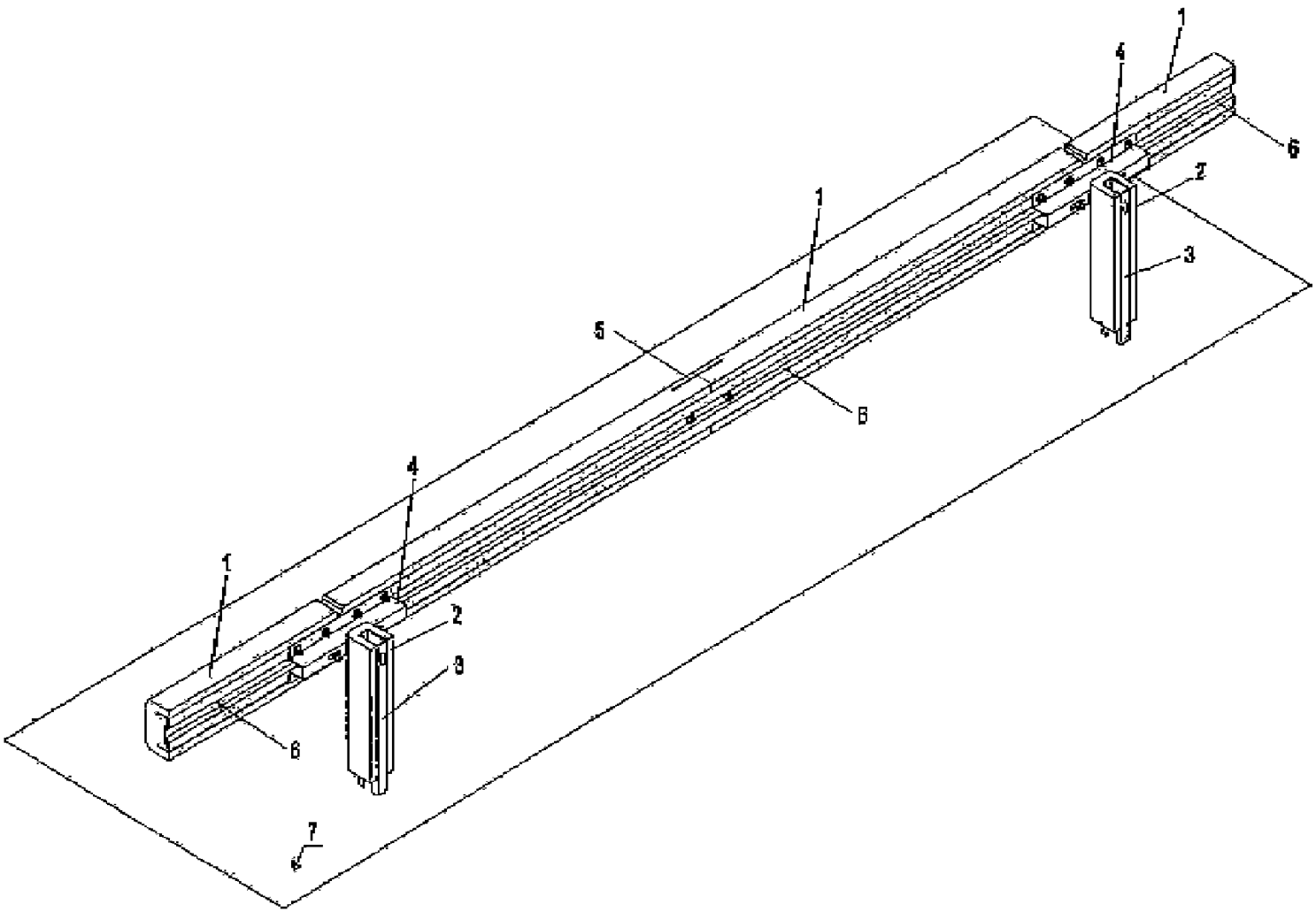
FIG. 2.—Corresponds to a lateral view in perspective of a stretch of mixed metal and wooden guardrail with several rails and posts, from the rear side or side away from the traffic.
Figure 3:
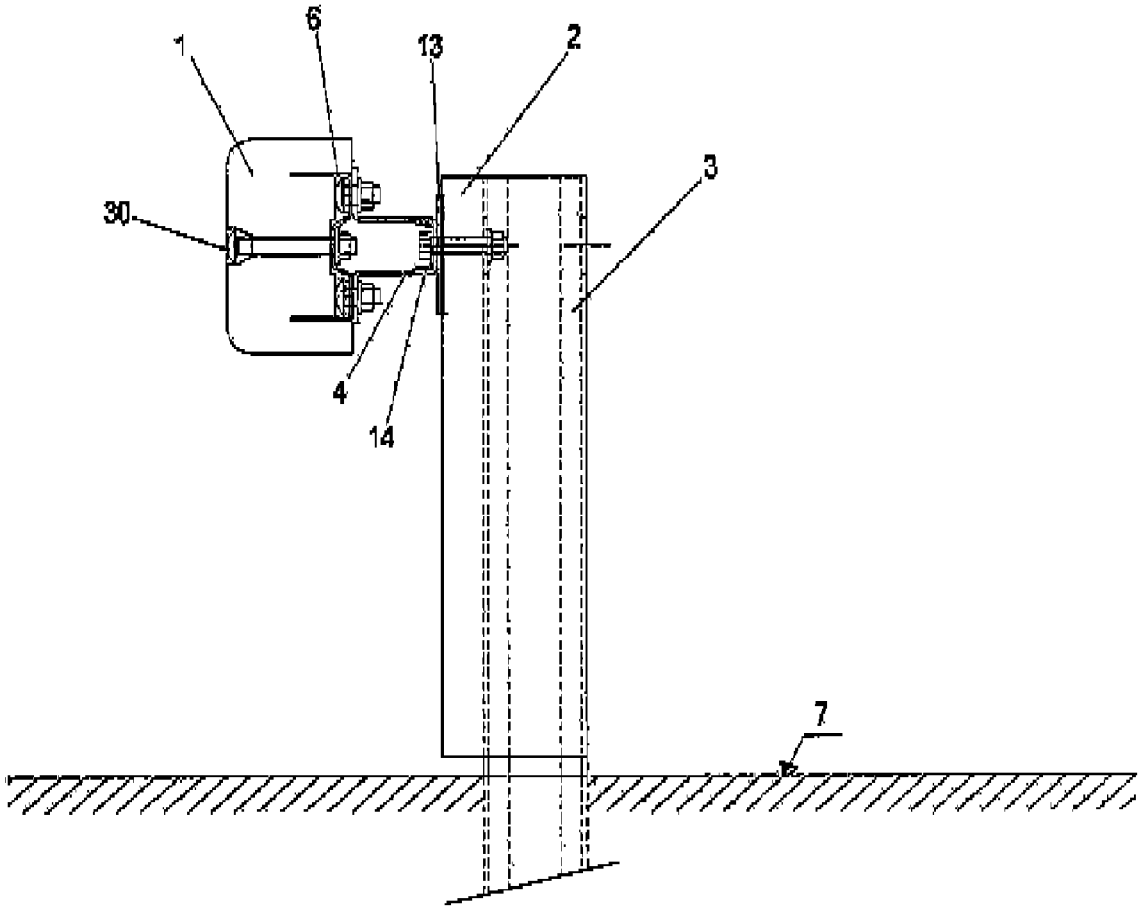
FIG. 3.—is a straight section of the mixed metal and wooden guardrail in the post.

The present invention relates to a Contention System for Lateral Impacts from Vehicles comprising one or various levels of continuous horizontal rails made of metal and wood arranged longitudinally and vertical metal support posts individually fitted with a wooden cover and arranged at regular intervals, with aesthetic qualities, which is characterised in that it comprises:

A mixed metal and wooden rail (1), a metal post (3) fitted with a wooden cover (2) and a spacer by way of support (4) which longitudinally connects the consecutive horizontal stretches of rail between each other and the latter with the post (see FIG. 1, FIG. 2 and FIG. 3).

Figure 4:
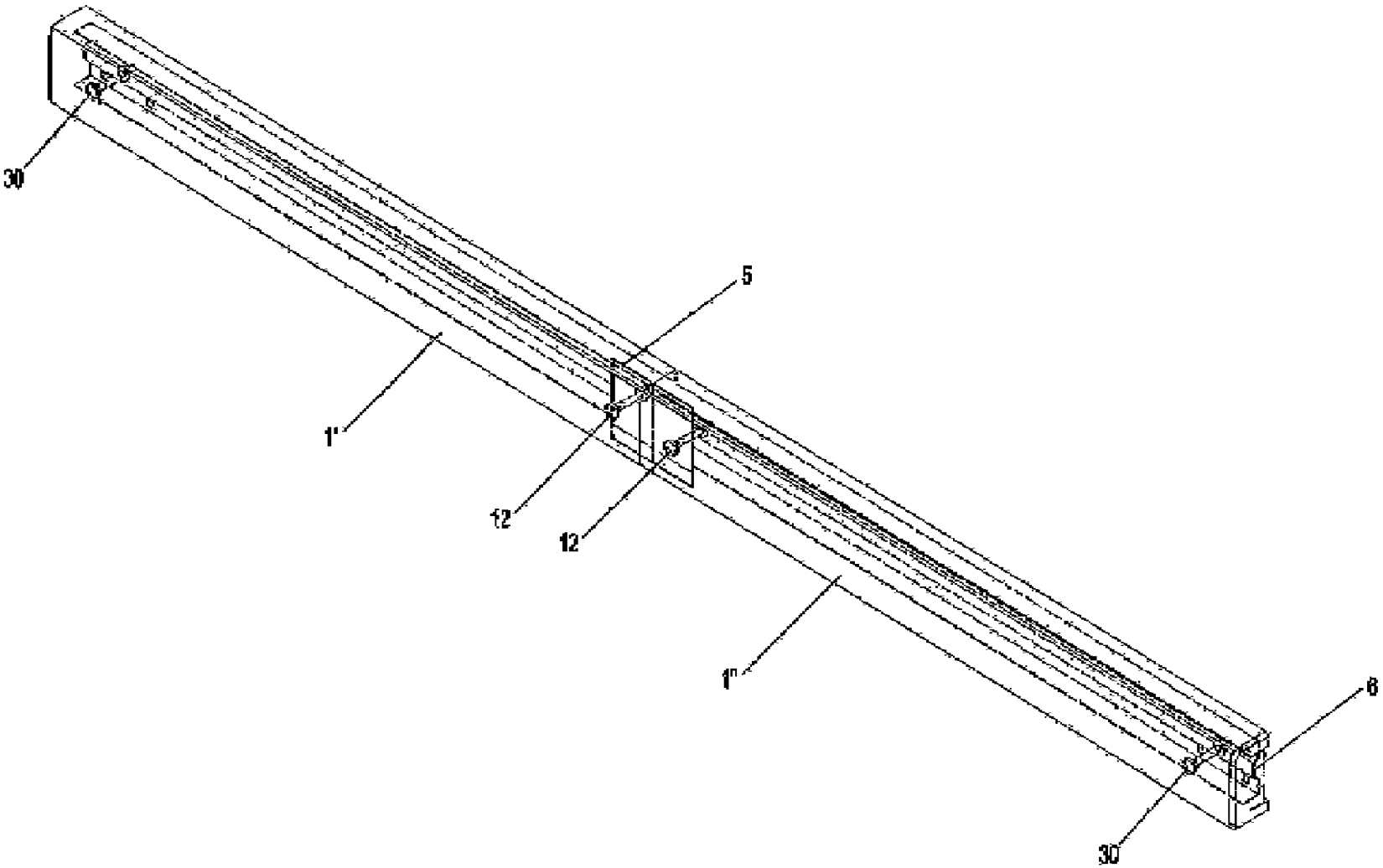
FIG. 4.—Corresponds to a perspective view from the traffic side of an individual rail.
Figure 4C:
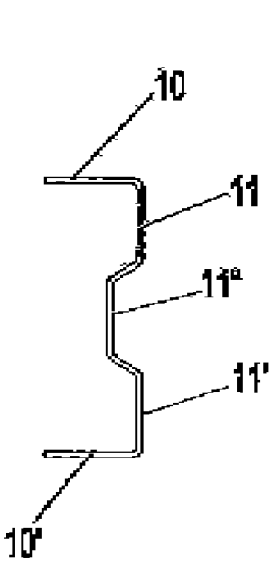
FIG. 4*c*.—is the straight section of the interior metal profile of the rail.
Figure 4B:
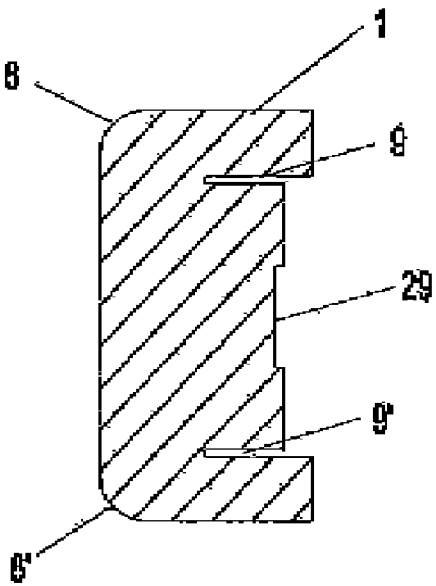
FIG. 4*b*.—is the straight section of one of the wooden logs of the rail.
Figure 4A:
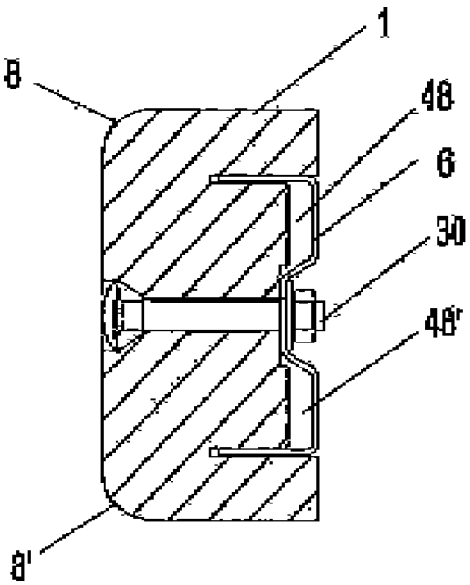
FIG. 4*a*.—is the straight section of a stretch of rail with wooden logs, the interior metal profile, the attachment element between the wooden logs and the metal profile and the attachment plate between logs.
Figure 4D:
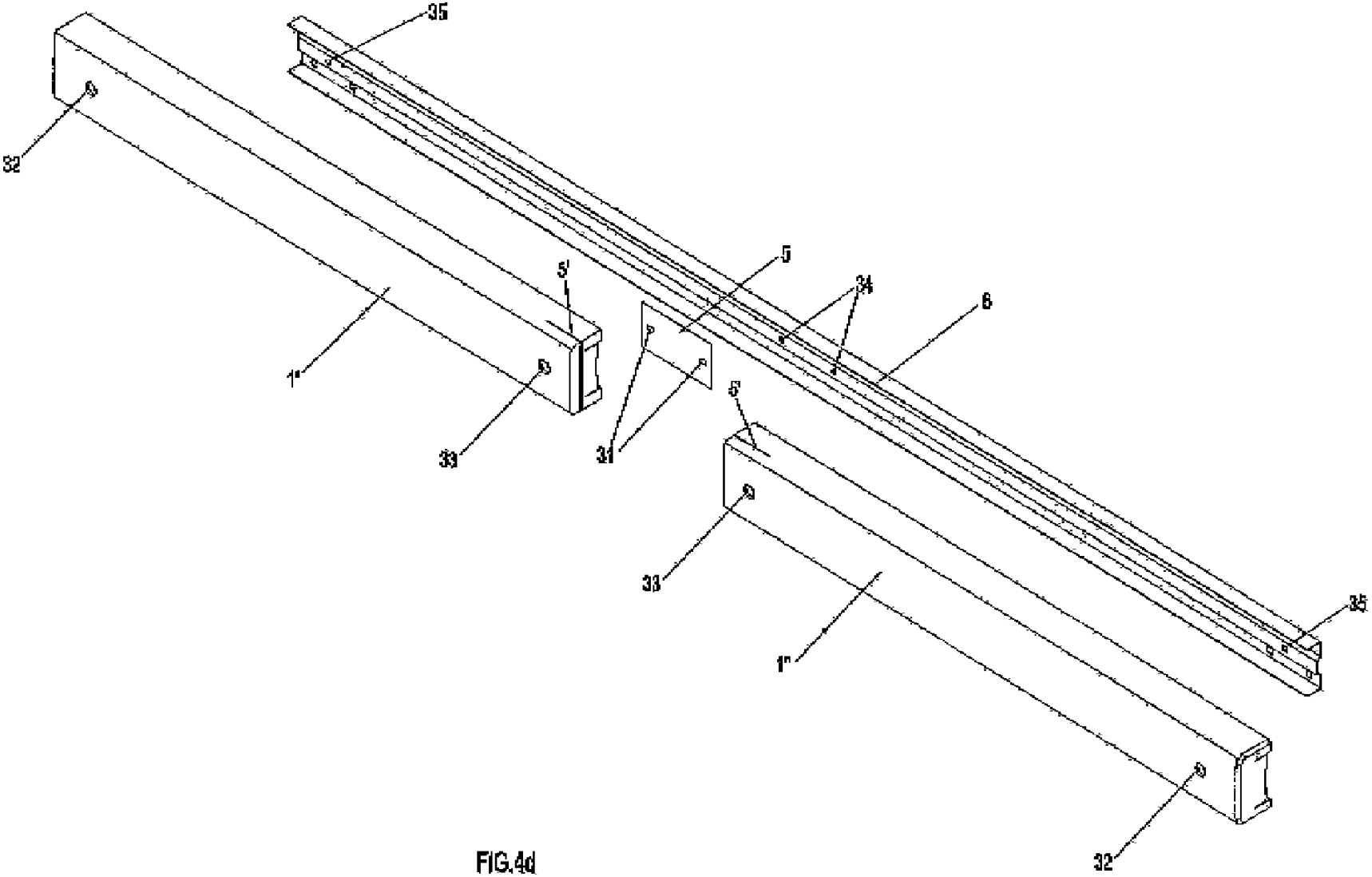
FIG. 4*d*.—Corresponds to a perspective exploded view of an individual stretch of rail, from the traffic side, with its components: wooden logs, metal profile and attachment plate.

Each rail (1) consists of: two or more longitudinal wooden logs or pieces (1') (1") of identical cross-section arranged longitudinally adjacent with their end sections in contact or very close and connected together by a metal attachment plate (5) housed in individual vertical slots (5') made for the purpose in the end of adjacent logs (1') (1"), a single metal profile (6) longitudinal and with cross-section preferably in the form of a "sigma", the length of which approximately corresponds to the sum of the lengths of the logs (1') (1") and suitable means of attachment (12) (30), preferably screwed, between the logs (1') (1") and the "sigma" metal profile (6), as can be seen in FIG. 4 and FIG. 4*d*.

Each wooden log (1') (1") has two horizontal slots (9) and (9') made from its rear face along its entire length and a "recess" (29) of appreciably rectangular cross-section made in the central part of its rear face corresponding to the space included between the slots, as can be seen in FIG. 4*b*. The corners (8) and (8') forming the front face of the log, which is the vertical face offered to the traffic, with the upper and lower faces respectively horizontal, are rounded in order to avoid aggressive contact with the vehicle which would be implied by the presence of sharp edges.

The "sigma" metal profile (6) presents in cross-section (see FIG. 4*c*) a vertical middle section (11)-(11")-(11') and separate horizontal arms (10) and (10'), upper and lower, respectively. The central part of the profile consists in turn, and from top to bottom, of an upper vertical section (11) which is connected to the upper arm (10) by means of a right-angle bend, a central vertical section or "notch" (11") displaced towards the Inside of the cross-section in the direction of the arms, and a lower vertical section (11') aligned with the upper vertical section (11) and which is connected to the lower arm (10') by means of a right-angle bend. The "notch" or central section (11") of the middle of the "sigma" profile (6) is connected to the vertical sections (11) and (11') of the central part by means of folds and suitably inclined arrangements.

The recess (29) in the rear face of the log (1') (1") made along its entire length is of approximately rectangular cross-section, higher than deep, and more or less centred vertically in the rear face. The depth of the recess (29) made along the entire length of the log (1') (1") is approximately equal to or slightly greater than the height of the notch (11") in the middle of the "sigma" metal profile, this being measured with reference to the aligned vertical sections (11) and (11') and towards the interior of the "sigma" metal profile (6). The height of the recess (29) in the rear face of the log (1') (1") is approximately equal to or slightly greater than the vertical distance between the upper (10) and lower (10') arms of the metal profile with "sigma" cross-section (6).

Once the rail (1) has been assembled starting from its components, the "sigma" metal profile (6) remains inserted in the wooden logs (1') (1") penetrating from the rear face, in other words, from the face away from the traffic, towards the front face or traffic face (see FIG. 4*a*), in such a way that the arms (10) and (10') of the "sigma" profile (6), arranged horizontally, are introduced into the horizontal slots (9) and (9') made for the purpose in the rear face of the logs (1') (1") along their entire length. The depth of the slots (9) and (9') in the logs is approximately equal though slightly greater than the length of the arms (10) and (10') of the "sigma" metal profile (6), in such a way that the vertical sections (11) and (11') of the middle of the "sigma" metal profile (6) are aligned approximately vertically with the rear face of the logs (1') (1") and the central vertical section or "notch" (11") of the middle of the "sigma" metal profile (6) is in contact with or very close to the central section of the rear face of the logs (1') (1") resulting following the recess (29) made in the central part, as can be seen in FIG. 4*a*.

In this way, two cavities are made along the entire length of the rail (1), an upper cavity (48) and a lower one (48), between the wooden log (1') (1") and the "sigma" metal profile (6), demarcated by the recess (29) of the log, the upper (11) and lower (11') vertical sections, respectively, of the "sigma" metal profile (6), the upper (10) and lower (10') arms, respectively, of the "sigma" metal profile (6) and the alignments between the notch (11") of the "sigma" metal profile and the two vertical sections (11) (11'), respectively. These cavities (48) and (48') will permit the head (46) of the attachment screws (20) of the rail (1) with the support (4) or "prisoner" screws (20) of the rail (1) to be housed in their interior, see FIG. 6*a* and FIG. 6*b*.

Moreover, as can be seen in FIG. 4*a*, the section in the form of a "sigma" of the metal profile (6) with the central vertical part of the middle in a "notch" (11"), oriented towards the front part of the rail, permits the nut for attachment and tightening of the screws or bolts (12) and (30) joining the logs (1') (1") with the "sigma" metal profile (6) of the rail (1) to be housed and hidden in the rear part of the "notch" (11").

The wooden logs (1') (1") of the rail each have a vertical slot (5'), provided at one of their ends, running from top to bottom, and located between the front face of the log and the cavity thereof, formed by the slots (9) and (9') and the recess (29), which house the "sigma" metal profile (6), said vertical slot (5') being made in the wood for the purpose of being able to house approximately half of the metal attachment plate (5), in such a way that once the rail (1) has been assembled starting from its components, the vertical slots (5') of adjacent logs (I') and (1") are in the same vertical plane and the attachment plate (5) remains embedded between two adjacent logs (1') (1") inside the slots (5') and, by means of suitable fastenings (12), said metal plate (5) functions as a longitudinal link between them. The means of fastening between the attachment plate (5) and the adjacent wooden logs (1') (1") is preferably a horizontal screwed attachment with the screw or bolt (12) successively traversing the log (1') or (1"), the attachment plate (5) and the "sigma" metal profile (6) via separate holes or openings (33), (31) and (34), preferably round, which have the same alignment and which have been made for the purpose in the log (1') or (1"), in the attachment plate (5) and In the "sigma" metal profile (6), respectively.

Figure 4E:
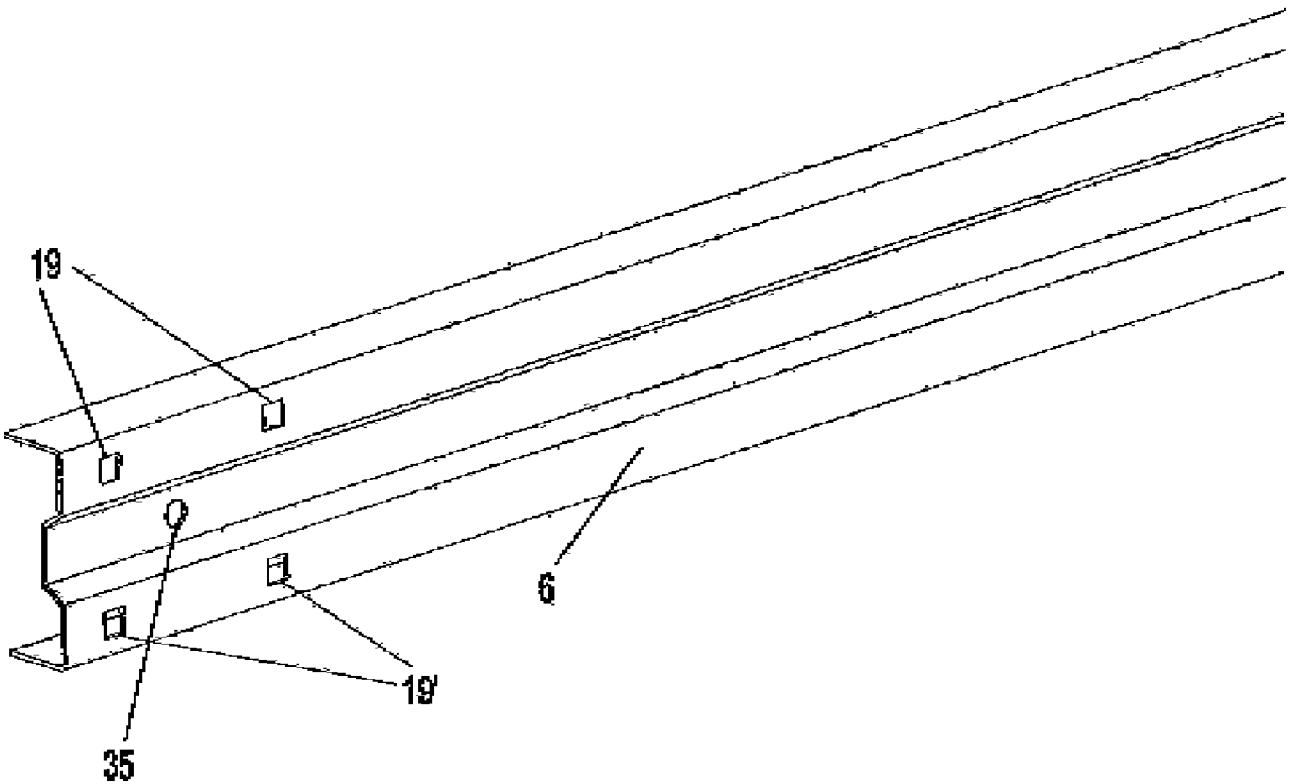
FIG. 4*e*.—Lateral view in perspective from the rear side of a stretch of the interior metal profile of the rail, with its holes for attachment to the log and with the support.

The "sigma" metal profile (6) presents various central holes along its is axis, both at its ends (35) and in the central zone (34), preferably round, located in the vertical "notch" (11") in the middle and destined to be traversed by the attachment elements (30) and (12) between the logs (1') (1") and the "sigma" metal profile (6). Likewise, the "sigma" metal profile (6) presents its end holes (19) and (19'), preferably square, located in upper (11) and lower (11') vertical sections, respectively, of the central part of the "sigma" metal profile (6), destined to be traversed by the attachment elements (20) between the rail (1) and the support (4). FIG. 4*e* shows all these holes. The holes (19) and (19') form an alignment of openings in the upper section (11) and another in the lower section (11'), respectively, in such a way that each alignment is composed of two or more holes. In this way, once the attachment has been carried out between two consecutive rails (1) by means of a common support (4), said attachment, due to consisting of at least two alignments of two bolts each, does not permit any relative rotations between the rails nor any kind of torsion between them The two or more wooden logs (1') (1") constituting an individual rail (1) are longitudinally attached to each other and to the same "sigma" metal profile (6) in order to form an individual rail (1), by means of suitable attachment elements, preferably screws or bolts (12) and (30). These attachment screws or bolts between the log (1') (1") and the "sigma" metal profile (6) are provided along the length of the rail (1), preferably located in the middle horizontal or equatorial plane thereof and, in general, they consist of a set of screw, washer and nut. Said attachment screws or bolts (30), preferably at the ends of the rail (1), successively traverse the wooden log (1') (1") and the "sigma" metal profile (6) passing successively through the holes (32) and (35), preferably round, made for the purpose in the wooden log (1') (1") and in the "sigma" metal profile (6), respectively. Said attachment screws or bolts (12) in the centre of the rail (1) successively traverse the wooden log (1') (1"), the flat metal attachment plate (5) and the "sigma" metal profile (6) passing through holes (33), (31) and (34), preferably round, made for the purpose in the wooden log (1') (1"), the flat metal attachment plate (5) and the "sigma" metal profile (6), respectively (see FIG. 4 and FIG. 4*d*). The head of the screws or bolts (12) and (30) are preferably arranged in the front face of the log and the corresponding nut in the rear face of the central part of the "sigma" metal profile (6), preferably, in the "notch" (11"). In this way, the attachment screws or bolts (12) between the logs (1') (1") and the "sigma" metal profile (6) located in the centre of the rail (1) also function as attachment elements for the metal attachment plate (5) between adjacent logs (1') (1").

Although the wooden logs (1') (1") and the "sigma" metal profile (6) of the rail (1), as described previously (vertical rectangular standard cross-section for the wooden log and "sigma" cross-section for the metal profile), represent the preferred embodiment of the Invention, since they are the most adequate solutions for the functioning of the system as a whole, the same invention on the rail (1) can also be embodied with other different geometries, both of the log and of the metal profile.

FIG. 14 shows some alternative designs for the cross-section of the rail (1), as are the square cross-section (FIG. 14*a*), the horizontal rectangular cross-section (FIG. 14*b*), the polygonal section (FIG. 14*c*), the midpoint cross-section (FIG. 14*d*), the semi-round cross-section (FIG. 14*e*) and the round cross-section (FIG. 14*f*). On the other hand, the metal profile (6) of the rail can alternatively be designed with a U-shaped cross-section, in such a way that the vertical sections (11) and (11') are now in the same vertical plane as the notch (11"), due to which the latter disappears and the U-shaped cross section is made up of two horizontal arms (10) and (10'), upper and lower, respectively, the same as in the "sigma" cross-section and a straight vertical central section (11)-(11")-(11').

The metal support (4) of the mixed guardrail is in turn made up of two metal pieces: a main piece or body (4) and an interior U-piece (14), joined together by suitable means of fastening, preferably a screwed attachment. The main piece (4) of the support is a metal piece of cross-section in the form of an "omega" lying on its side, with its flanges or feet (upper and lower) and the middle part arranged vertically and the arms arranged horizontally or slightly inclined. It constitutes the structural resistant element of the support and the connection element with the rails (1) and for these with themselves. The U-piece (14) is a single piece, appreciably smaller than the main piece (4), with cross-section preferably in the form of a "U", "C" or a flat or slightly curved plate, preferably of lesser length than the main piece of the support (4) and, together with the attachment screws (24) between the support (4) and the metal post (3), it constitutes the breakaway element with the metal post (3), as can be seen in FIG. 5, FIG. 5*a* and FIG. 5*b*.

The main piece of the support (4) is provided in its upper vertical flange with a series of holes (18) aligned horizontally and in its lower vertical flange with another series of holes (18') aligned horizontally, preferably being arranged symmetrically with each other (18) and (18') with respect to the axis of the support and with a shape that is preferably rounded, elongated or oblong or square, so that they can be traversed by the means of attachment between consecutive rails (1) and the support (4), preferably by means of screwed attachments. Once the two consecutive rails (1) have been suitably joined together and with the common support (4), the series of upper (18) and lower (18') holes of the support (4) must correspond, one by one, with the series of upper (19) and lower (19') holes of the "sigma" metal profile (6) of the rail (1) (see FIG. 6).

Figure 5B:
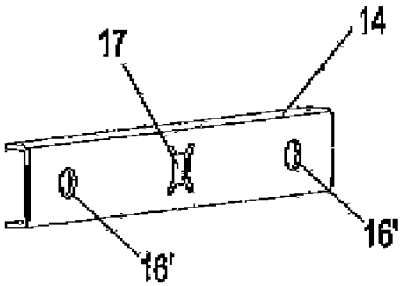
FIG. 5*b*.—Lateral view in perspective from the rear side of the interior piece of the support.
Figure 5A:
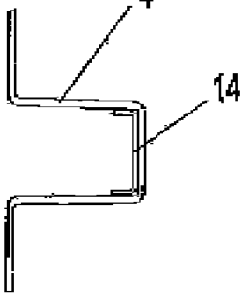
FIG. 5*a*.—Straight section of the support with its two component pieces.
Figure 5C:
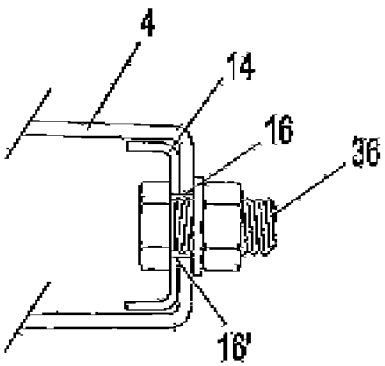
FIG. 5*c*.—Straight section of a detail of the support with its two component pieces and the attachment element between them.
Figure 5:
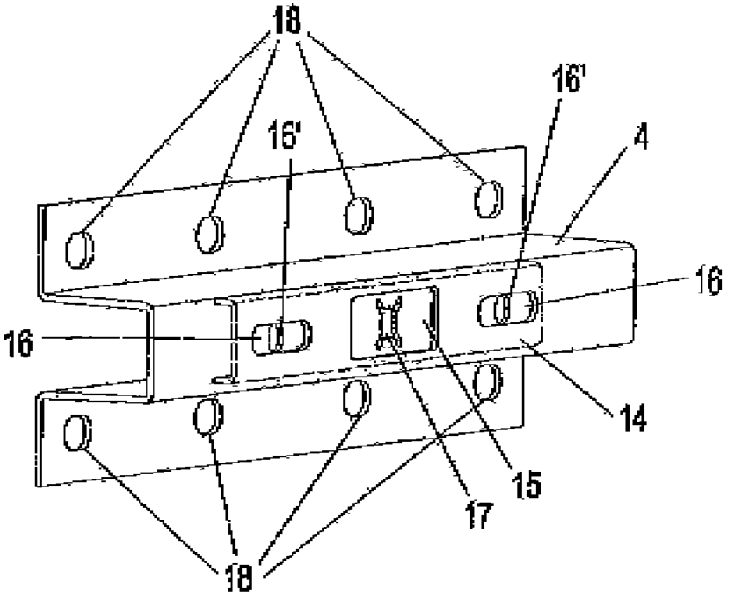
FIG. 5.—Lateral view in perspective from the rear side of the support with its two component metal pieces, the main piece and the interior piece, assembled.

The main piece of the support (4) is provided with a central window (15) in its middle, having a shape that is preferably rectangular, square or oval and with two or more elongated holes (16), arranged on both sides of the window (15), preferably aligned horizontally with it, as can be seen in FIG. 5. These holes (16) are designed to be traversed by the means of attachment, preferably a screw or bolt (36), between the two pieces (4) and (14) composing the metal support, as shown in FIG. 5*c*.

Figure 7:
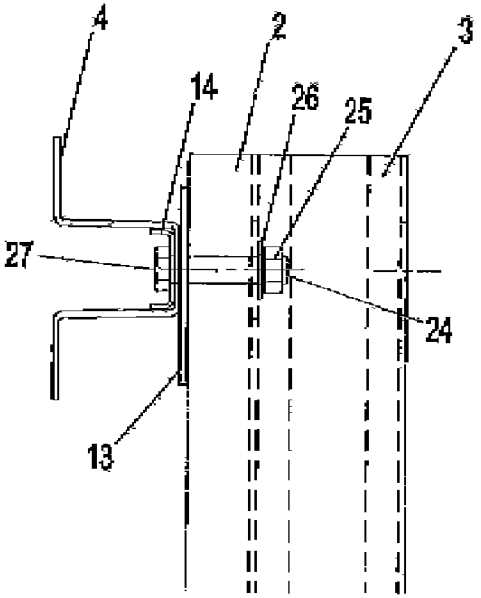
FIG. 7.—Straight section of the mixed metal and wooden guardrail in the post without the rail, with the metal post, the cover for the post, the two component pieces of the support and the attachment element between the support and the metal post, via the wooden cover.

The interior U-piece (14) of the support has a star-shaped hole or opening (17), preferably in the central part of the piece, and two or more rounded holes (16') arranged on both sides of the star-shaped hole (17), preferably aligned horizontally with it, as can be seen in FIG. 5*b*. The star-shaped hole (17) is designed to be traversed by the means of attachment, is preferably a screw or bolt (24) with a preferably hexagonal head (27) with a washer (26) and nut (25), between the support (4) and the metal post (3), as shown in FIG. 7. The star-shaped hole (17) presents a round or oval central opening of dimensions slightly greater than the diameter of the shaft of the screw or bolt (24) for attachment between the metal support (4) and the metal post (3) but less than the diameter of the head (27) of said screw or bolt (24), and a series of slots, of length greater than their thickness, arranged radially around the central gap and connected to it in such a way that, between every two slots there remains a portion of metal sheet of the U-piece (14) by way of flap which, in the event that an axial force gradient is applied between the screw or bolt (36) and the support (4), this flap can become deformed, becoming bent until it allows the head (27) of the screw or bolt (24) to pass through the central gap of the star-shaped hole (17). The round holes (16') of the U-piece (14) of the support are designed for being traversed by the means of attachment, preferably a screw or bolt (36), between the two pieces (4) and (14) comprising the metal support, as shown in FIG. 5*c*.

The main piece of the support (4) and the interior U-piece (14) of the support are assembled together in order to constitute the metal support (4), in such a manner that the U-piece (14) is arranged inside the main piece of the support (4) with the central part of the U-piece (14) resting completely against the interior wall of the central part of the main piece (4), as shown in FIG. 5*a*, the star-shaped hole (17) of the U-piece (14) remaining facing the window (15) of the central part of the main piece of the support (4) and the round holes (16') of the U-piece (14) facing the elongated holes (16) of the central part of the main piece of the support (4) as shown in FIG. 5, and both pieces (4) and (14) being joined together by means of suitable means of attachment, preferably by means of screws or bolts (36) which successively traverse the U-piece (14) of the support and the main piece of the support (4), via the holes (16') and (16), respectively, as indicated in FIG. 5*c*.

Once the two metal pieces (4) and (14) forming the support have been arranged in position and assembled together using suitable means of fastening, preferably screws or bolts (36), the fact that the holes (16') of the U-piece (14) are round and their corresponding holes (16) of the main piece (4) are elongated or oblong for the purpose of being traversed by the screws or bolts (36), means that, prior to proceeding to the final tightening of the attachments (36), the U-piece (14) can be displaced horizontally with respect to the main piece (4), towards one side and the other by a certain distance in such a way that the star-shaped hole (17) corresponding to the attachment screw (24) between the support (4) and the metal post (3) can be displaced horizontally to one side and the other within the window (15) of the main piece of the support (4), as shown in FIG. 5, with respect to the vertical position of the corresponding hole (40) in the wooden cover (2) and (41) in the metal post (3). This horizontal displacement permits horizontal adjustment of the rail (1) with respect to the vertical post (3) during installation of the guardrail, something that is essential for correcting the inevitable deviations that take place during the process of inserting the post (3) in the ground (7).

Alternatively, the adjustment of the horizontal position of the rail (1) with respect to the post (3) of the guardrail, by means of the relative displacement between both pieces (4) and (14) of the support, can equally be achieved by means of the combination of round holes (16) (instead of elongated ones) in the central part of the main piece of the support (4) and elongated or oblong holes (16') (instead of round ones) in the U-piece (14).

Figure 6A:
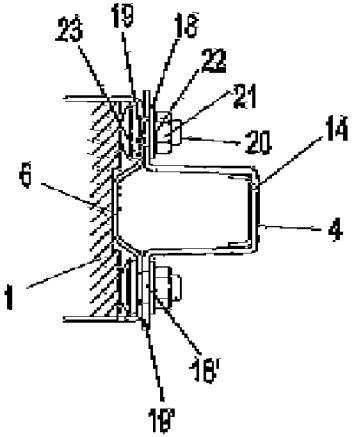
FIG. 6*a*.—Complete straight section of the support and part of the rail, assembled, with the attachment elements between both.
Figure 6B:
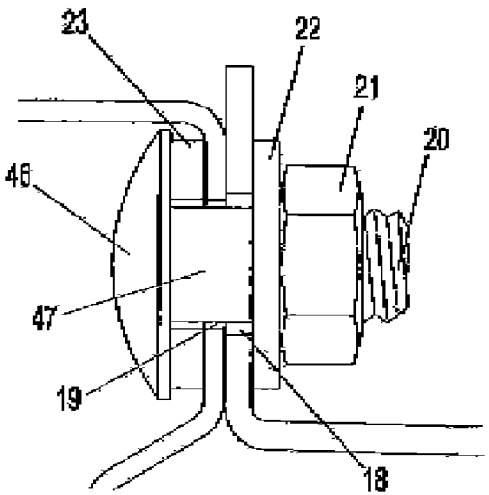
FIG. 6*b*.—Straight section of a detail of the support and metal profile of the rail, with one of the attachment elements between them.
Figure 16:
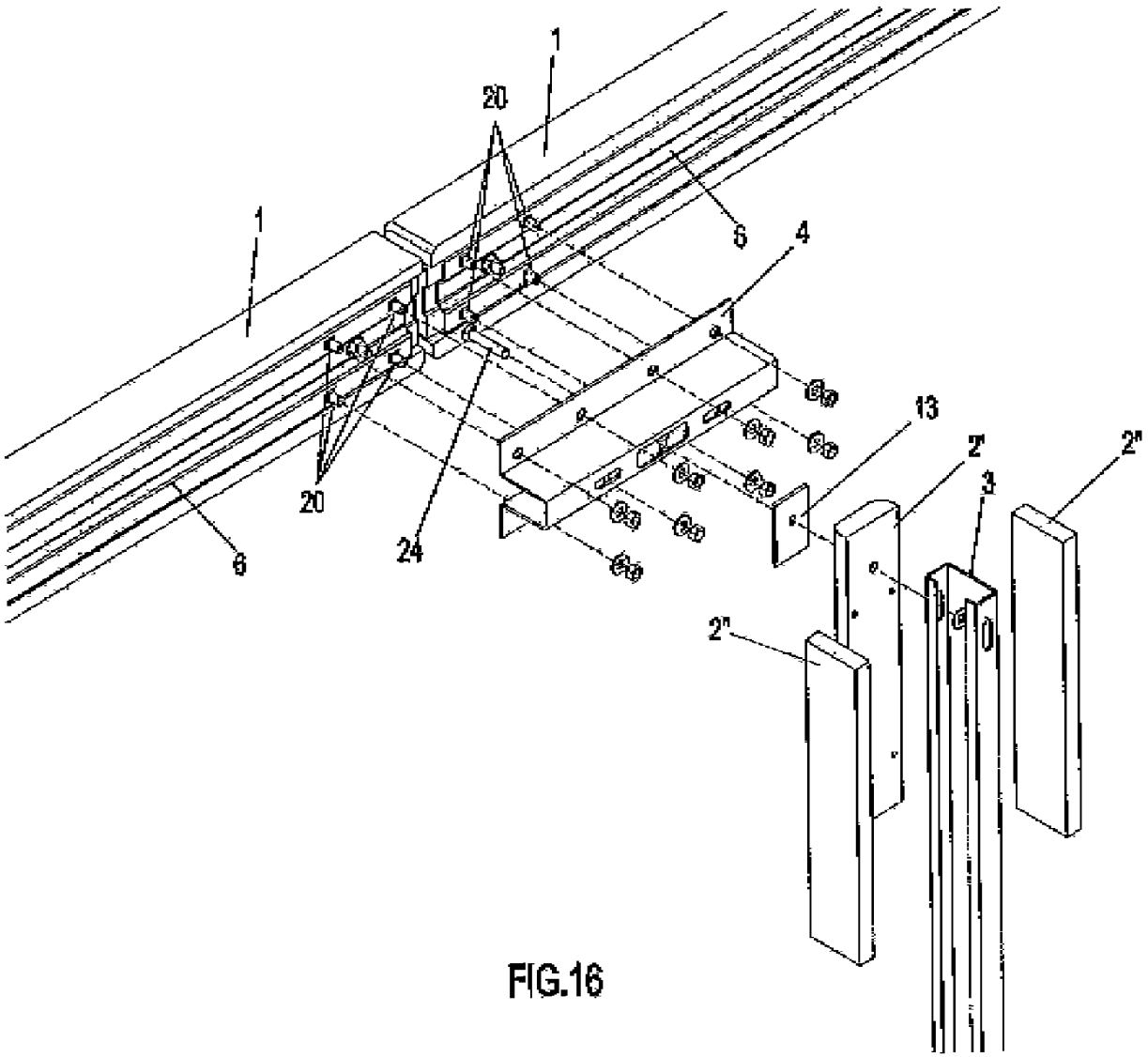
FIG. 16.—Perspective exploded view of the components of the mixed metal and wooden guardrail, in the environs of a post, from the rear side, showing two consecutive rails, the common support, the support plate, the wooden cover and the common metal post, along with the fastening elements among them.

The attachment of two consecutive rails (1) together with the mediation of the support (4), as shown in FIG. 6 and in FIG. 16 in a more general manner and in an exploded view, is done by arranging the metal support (4) between the ends of consecutive rails (1), appreciably centred between them, with the upper and lower flanges or feet of the support (4) in contact with the upper (11) and lower (11') sections, respectively, of the central part of the "sigma" metal profile (6), making the alignments of holes (19) and (19') of the metal profile (6) correspond one by one with the alignments of holes (18) and (18') of the flanges or feet of the support (4), respectively, and each of these attachments is fastened by means of "prisoner" screws or bolts (20), with a head that is preferably round (46) and neck preferably square (47), with their axes arranged horizontally or slightly inclined, remaining imprisoned in the rail (1) due to having their head (46) "confined" between the log (1') (1") and the metal profile (6), as is seen in FIG. 6*a* and FIG. 6*b*. In fact, the head (46) of each of the screws (20) remains imprisoned in the gap existing between the central, preferably rectangular, recess (29) of the rear face of the wooden log (1') (1") and the Internal face of the central part of the metal profile (6) of the rail, thanks to the fact that the dimensions of the holes (19) and (19') of the metal profile (6) are smaller than the size of that head (46), which does not pass through them, and greater than the diameter of the shaft so that, once the support (4) has been properly arranged facing the consecutive rails (1), the shaft of the "prisoner" screw or bolt (20) successively traverses the corresponding hole (19) or (19'), of preferably square shape, of the metal profile (6) of the rail and the corresponding hole (18) or (18') of the metal support (4). The attachment remains fixed by means of a closing nut (21), threaded and tightened on the shaft of the bolt (20) on the side of the support (4) and, preferably, with a washer (22) located beneath the nut (21).

In order to guarantee that, in the event of a considerable gradient of forces being applied between the rail and the support, the head (46) of the attachment screw or bolt (20) between the rails and support cannot deform the hole (19) or (19') of the metal profile (6) of the rail (1), and it becomes torn and is traversed, thus releasing the attachment between rails and the support, a washer (23) is provided, preferably square, between the head (46) of the bolt (20) and the "sigma" metal profile (6).

In order to permit the tightening of the nut (21) of the attachment screw (20) for the rails with the support, without the head rotating free in its confinement gap within the rail, the use of a screw (20) with a neck (47) of preferably square cross-section or provided with one or more projections, is combined with a hole (19) or (19') of the metal profile (6) of the rail, preferably square or rectangular in shape, in such a way that once the neck (47) of the screw (20) is housed or completely traverses the hole (19) or (19') of the profile (6), its rotation remains blocked.

Although the attachment between consecutive rails and between them and the support, which has been described above, is conceived for resisting stresses without breaking, thereby maintaining the continuity of the rails along the entire stretch of safety guardrail, on the other hand, the attachment between the support (4) and the metal post (3) is designed to break at a certain level of stress, releasing the rail from its connection to the post. For this reason, this type of attachment is known as "breakaway" and it is essential that it is done correctly so that the guardrail can satisfactorily contain the impact of a vehicle.

Figure 8:
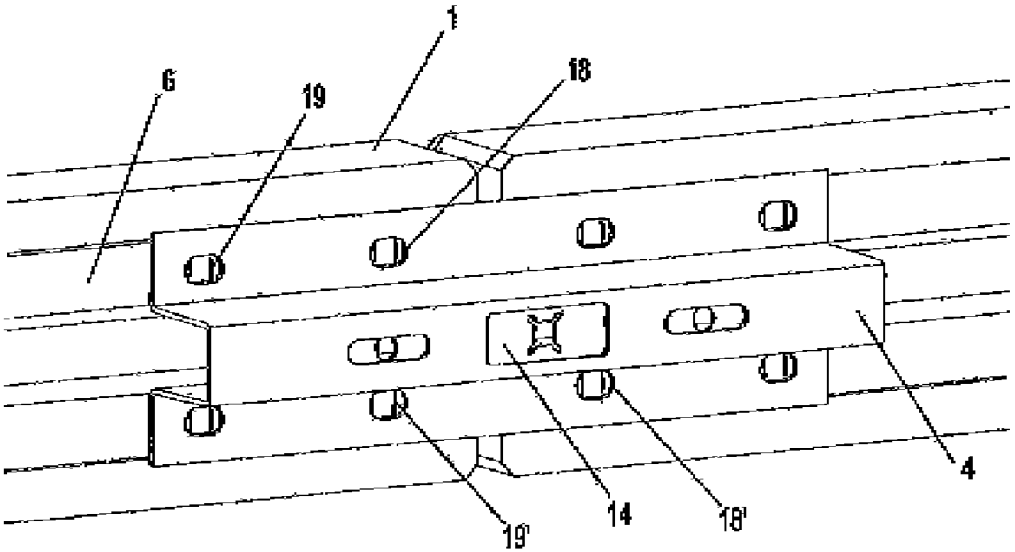
FIG. 8*a*.—Perspective view from the traffic side of the metal post, the wooden cover and the support plate, assembled.
FIG. 8*b*.—Perspective exploded view from the traffic side of the metal post, the wooden cover and the support plate, assembled.
Figure 8A:
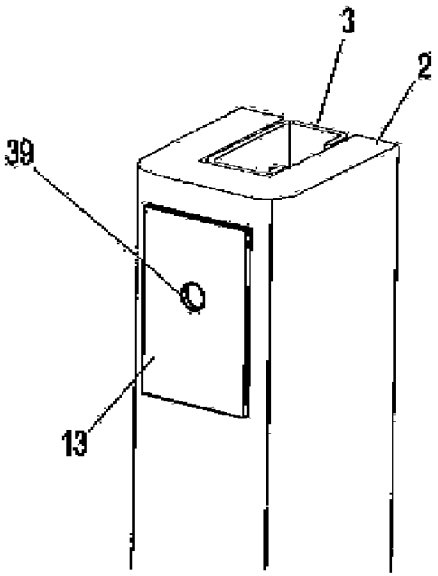
Figure 8B:
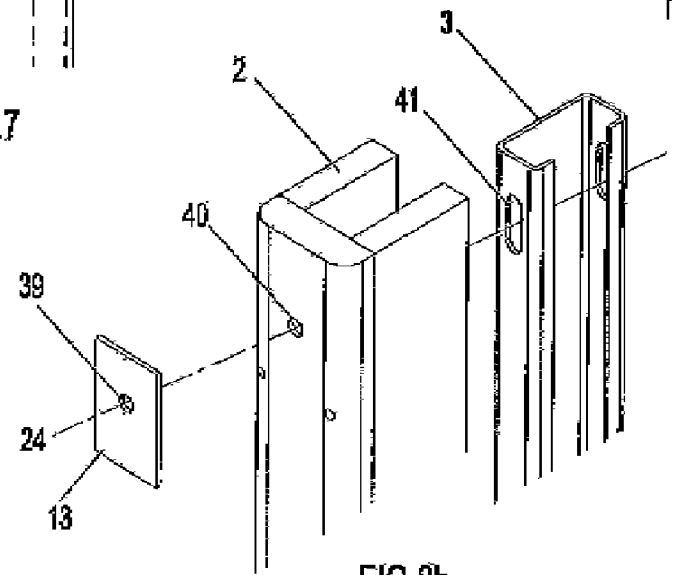

The breakaway attachment between the support (4) and the metal post (3) is carried out by means of a screw or bolt (24), with a preferably hexagonal head (27), arranged with its longitudinal axis horizontal or slightly inclined, in such a way that the head (27) remains located inside the metal support (4), in contact with the interior face of the U-piece (14) and the shaft of the bolt (24) successively traverses the star-shaped hole (17) of the U-piece (14), the window (15) of the central part of the main piece of the support (4), the hole (39), preferably round, of the metal support plate (13) for the support (4) in the wooden cover (2), the hole (40), preferably round, of the front part of the wooden cover (2) and the hole (41), preferably elongated in the vertical direction, of the metal post (3), the attachment being fastened by means of a nut (25) which is housed inside the post, correctly tightened. A washer (26) can be located beneath the nut, in contact with the interior wall of the front face of the post (3). FIG. 7, FIG. 8*a* and FIG. 8*b* describe the embodiment of this attachment and FIG. 16 shows it in a more general way in an exploded view.

Interposed between the metal support (4) and the front face of the wooden cover (2) is a metal plate (13), preferably rectangular or square, with a central hole (39), preferably round, for the purpose of being traversed by the shaft of the screw or bolt (24) for the breakaway attachment between the support (4) and the post (3). The dimension of the vertical side of the support plate (13) has to be such that the central part of the support (4) rests completely on it, without it emerging above the wooden cover (2), and the horizontal dimension must be less than the width of the front face of the wooden cover (2). The metal plate must have a thickness such that it is sufficiently rigid for being able to function as a distributor, on the wooden surface that it covers, of the force transmitted to the lower edge of the central part of the support (4), as a consequence of the moment originated by the weight of the rail and the span of the support (4) as an arm or lever. The metal support plate (13) prevents the lower edge of the central part of the support (4) from "sinking" slightly into the wood of the cover (2).

Figure 9:
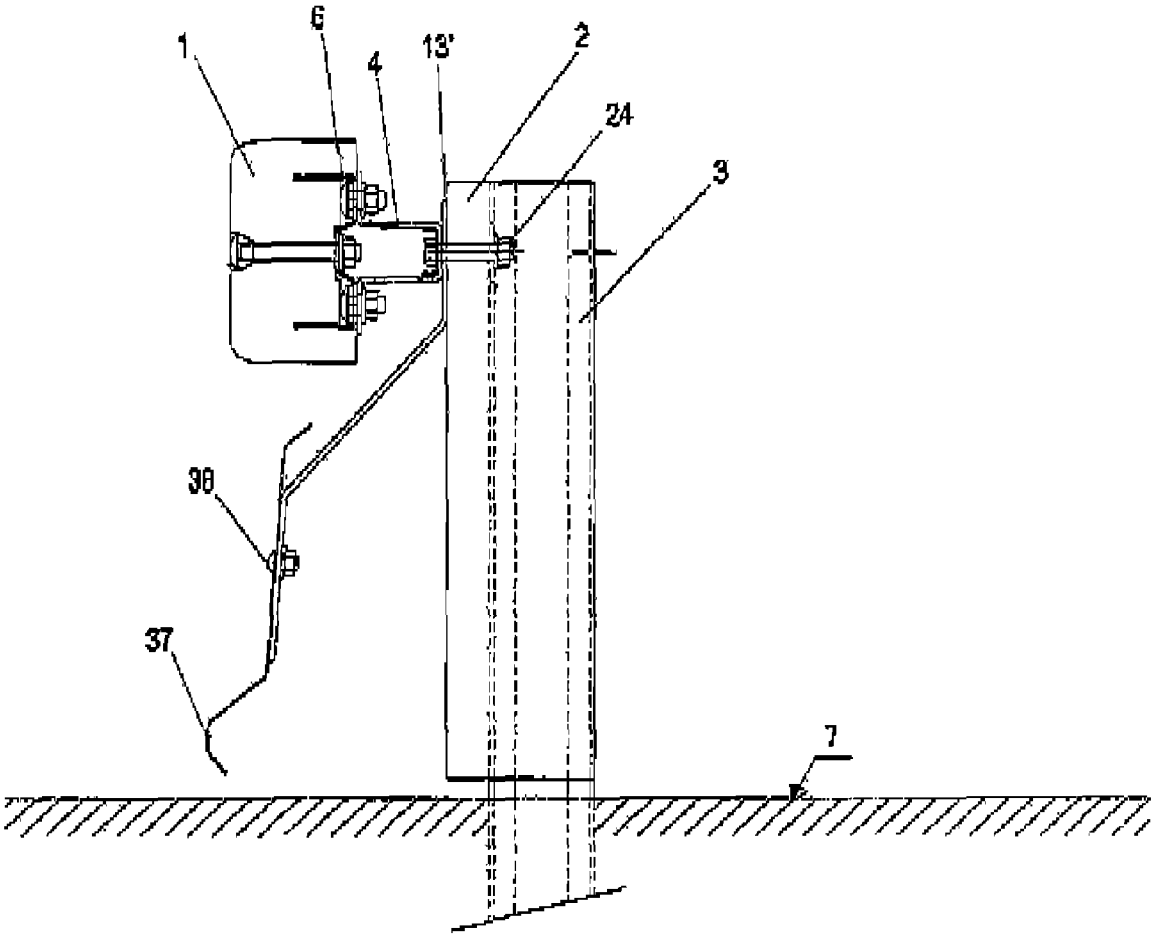
FIG. 9.—Is the straight section of the mixed metal and wooden guardrail in the post, with a lower metal screen for protection of motorcyclists suspended from the support by an arm as an extension of the support piece.

A construction variant of the support plate (13) described above is obtained by extending said plate via its lower part by way of an arm (13'), in such a way that the metal piece ceases to be plane and acquires a certain shape or geometry, with the aim that the lower part of this arm (13') sustains a screen (37) made of metal or a plastic material, arranged longitudinally and continuously beneath the rail (1) covering a large part of the gap existing between the latter and ground level (7), and fastened to the arm (13') by suitable means of attachment (38), preferably screwed attachments, as shown in FIG. 9.

Figure 11C:
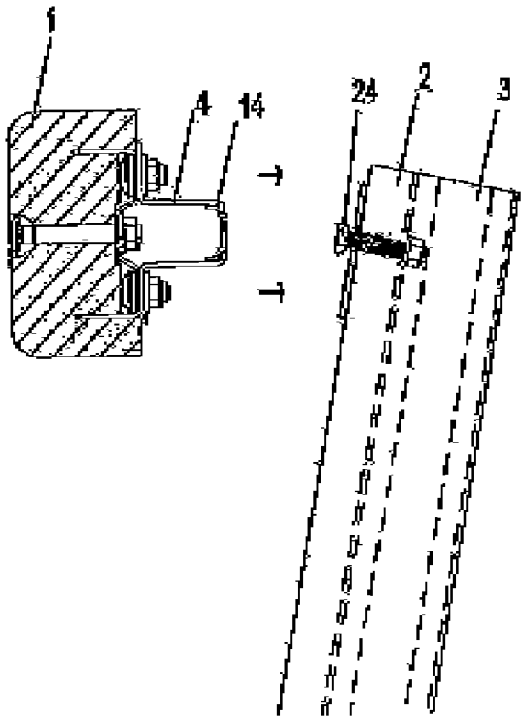
FIG. 11.—Deformation sequence (FIGS. 11*a*, 11*b* and 11*c*) of the straight section of the guardrail against lateral impact from a vehicle with the breakaway mechanism between the support and post.
Figure 11B:
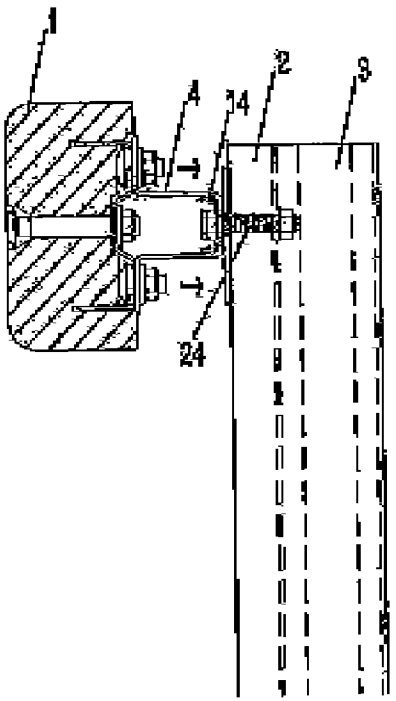
Figure 11A:
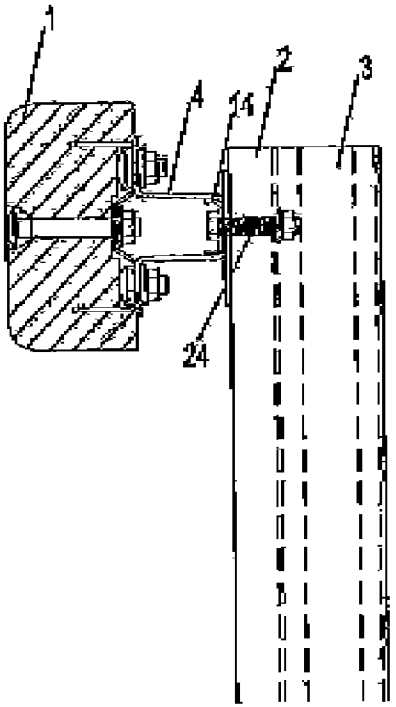
Figures 12A, 12B, 12C:
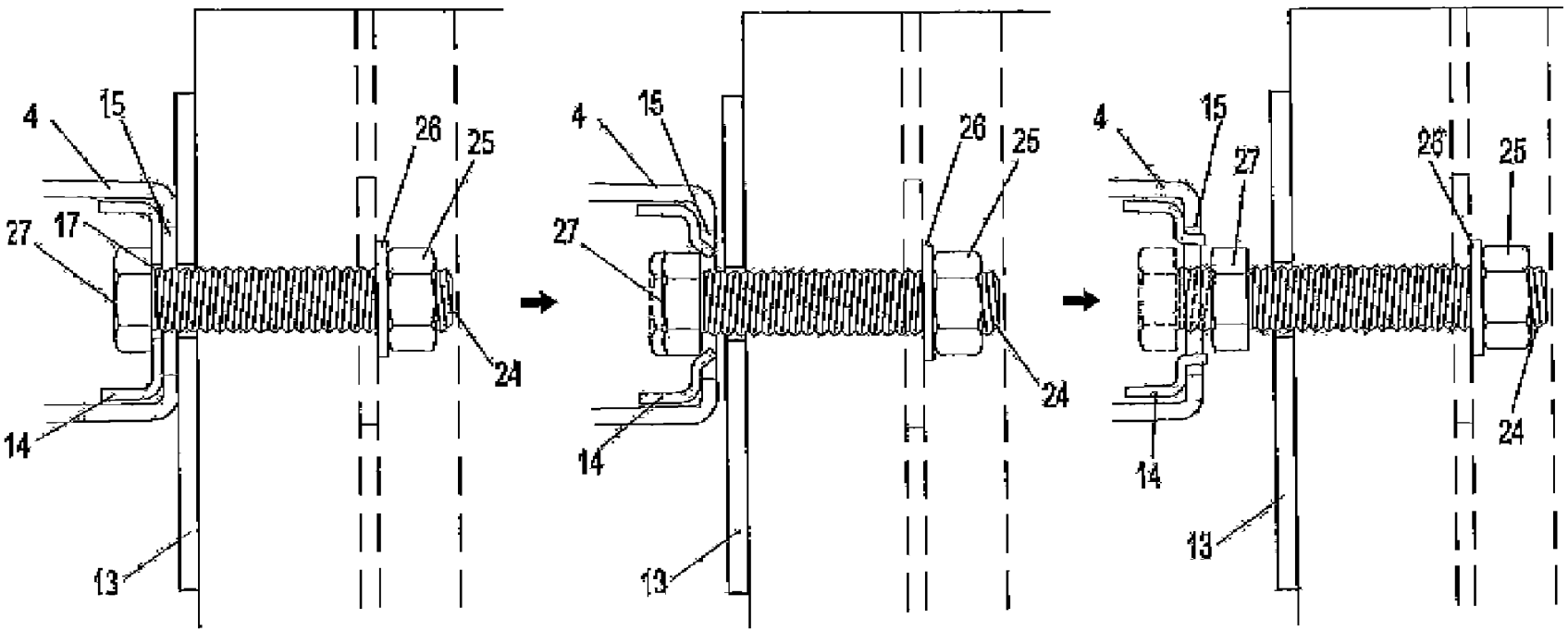
FIG. 12.—Sequence (FIGS. 12*a*, 12*b* and 12*c*) of the breakaway mechanism between the support and post as a consequence of the lateral impact of a vehicle.
Figure 13A:
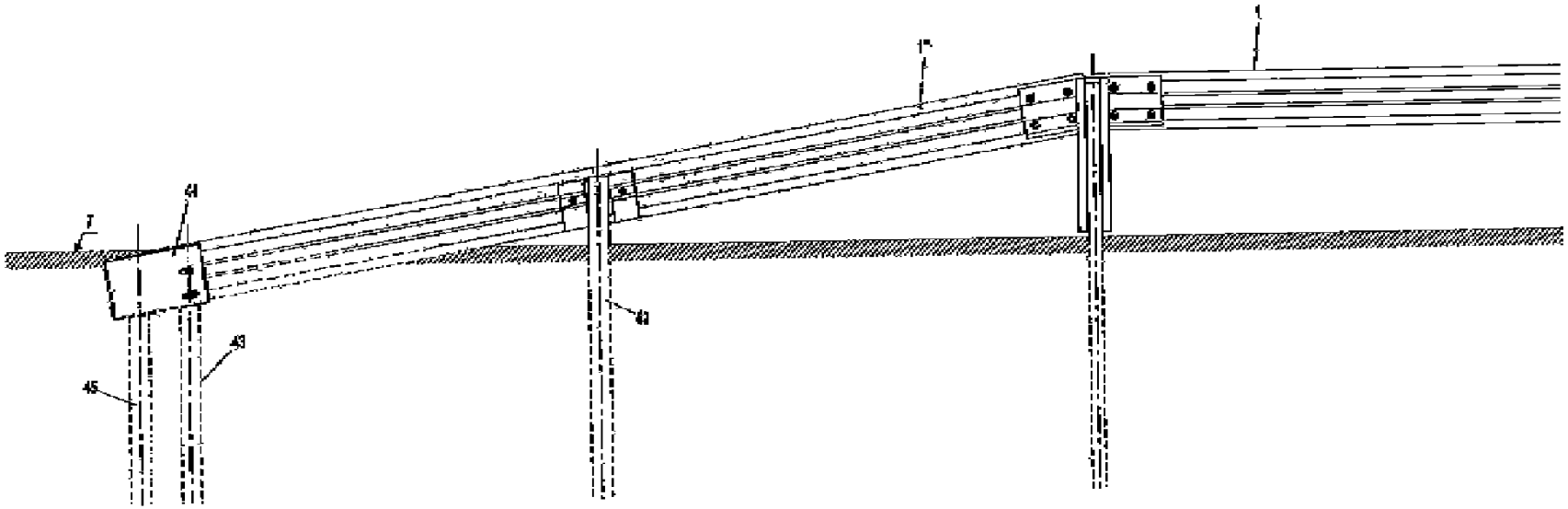
FIG. 13*a*.—Rear view in elevation of an end section and anchorage of the mixed metal and wooden guardrail with the rail folded down towards the ground FIG. 13*b*.—Plan view of an end section and anchorage of the mixed metal and wooden guardrail with the rail folded down towards the ground.
Figure 13B:
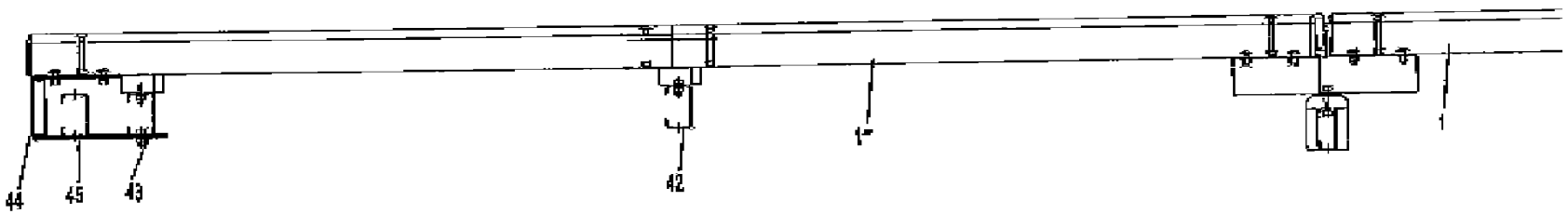

The arrangement of all the elements constituting the breakaway attachment mechanism between the rail and the post has to be coherent with the whole, in such a way that said attachment breaks in a way that is controlled and reliable as has been designed, as illustrated in the sequences of FIG. 11 (in a general way) and FIG. 12 (in detail). When, owing to the impact of a vehicle against the guardrail, the stresses transmitted to the support (4) give rise to a certain gradient of force between the support (4) and the post (3) in the direction of the longitudinal axis of the screw or bolt (24) for the support-post attachment, the head of that screw or bolt (24) deforms the flaps of metal sheet included between the arms of the star-shaped hole (17) of the interior U-piece (14) of the support (4) and it passes through that hole (17) tearing it and releasing the connection between the metal support (4) and the metal post (3). Both the screw or bolt (24) of the breakaway attachment and the metal support plate (13) remain solidly attached to the metal post (3). The wooden cover (2) can break into fragments and become detached.

The wooden cover (2) placed over the metal post (3) of the mixed metal and wooden guardrail covers at least the three faces of the post (3) visible from the traffic side, namely, the front face (2') and the two side faces (2"), along virtually the entire length of the post (3) emerging above the ground (7), once the post (3) has been inserted therein.

Figure 10B:
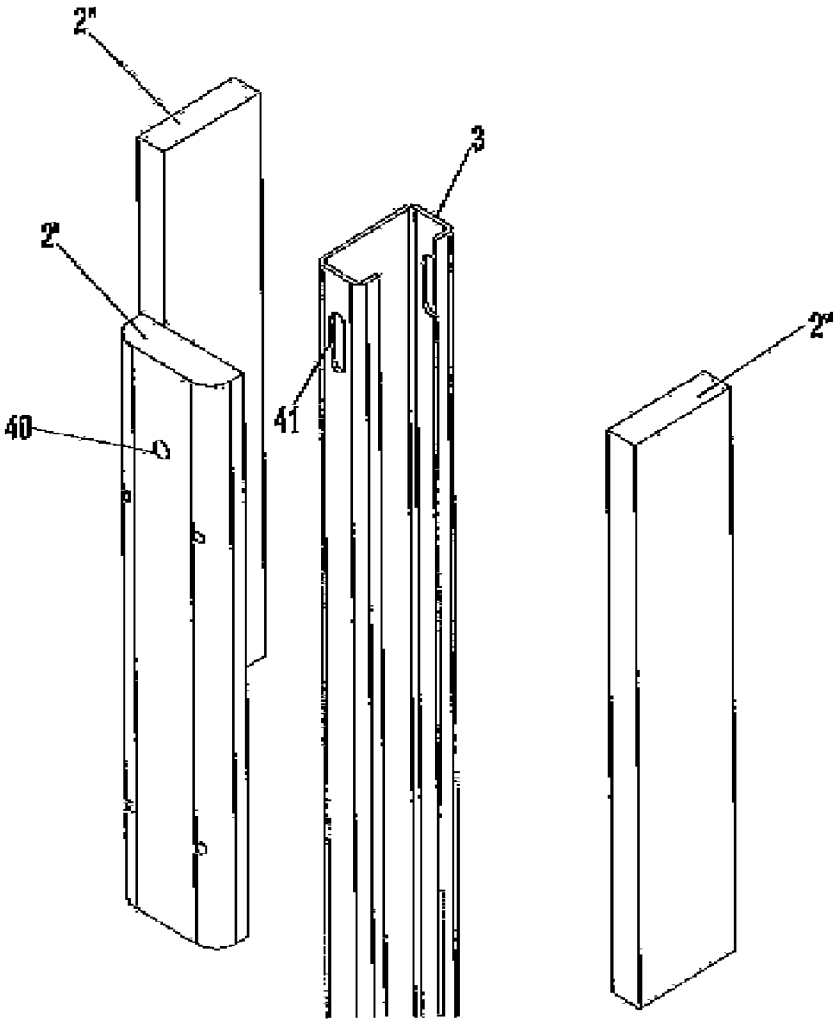
FIG. 10*b*.—Perspective exploded view from the traffic side of the metal post and the strips of wood making up the cover for the post.
Figure 10A:
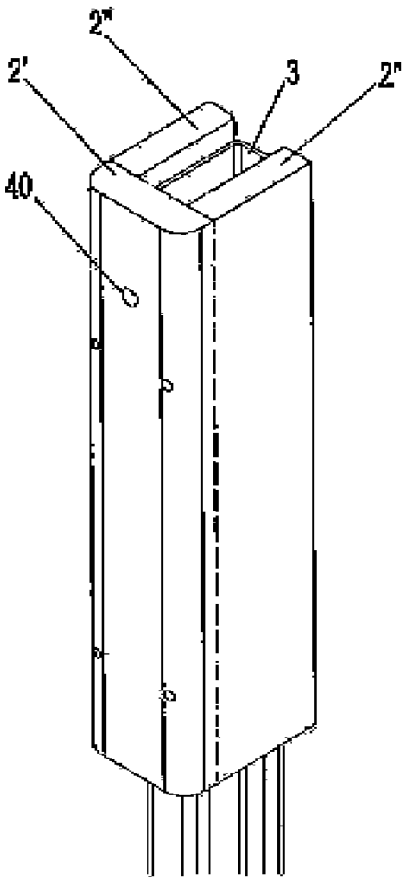
FIG. 10*a*.—Perspective view from the traffic side of the metal post covered with the wooden cover, assembled.

With the aim of encouraging a controlled fragmentation of the wooden cover (2) of the metal post (3) during impact by a vehicle, said wooden cover (2) is decomposed into at least three flat strips or planks of wood (2') (2") covering at least the front face and the two side faces of the metal post (3), as indicated in FIG. 10*a* and FIG. 10*b*. The flat strips or planks of wood (2') and (2") are assembled together by suitable means of fastening, preferably with spikes, screws, bolts, nails, staples or glued, in such a way that these attachments are easily broken by the forces originated by the impact of a vehicle against the guardrail, facilitating the detachment of the strips (2') and (2").

The wooden cover (2) of the metal post (3) can additionally include a flat enclosure strip in the rear part, so that the post (3) is completely covered with wood.

The end sections of a stretch of mixed metal and wooden guardrail are constructed by folding the rail (1) towards ground level (7) and burying its end attached to a metal stop piece (44) generally hook-shaped and fixing said folded rail (1") in one or more metal posts (42) (43) inserted or secured into the ground and joined to the folded rail (1') by means of metal pieces. In the event that, as a consequence of the impact of a vehicle against the guardrail, the forces transmitted along the rail (1) as far as the end were to cause breakage of the ground Inside the hook-shaped end stop (44), the joins between the posts fixed to the folded rail (1") would have to withstand the entire tension transmitted and, as they are not made to do so, they break and the stretch of rail (1) (1'") would become released and remain without tension, and the guardrail would thus lose its entire capacity for contention. In order to guarantee that this phenomenon of end breakage and loss of tension by the rail (1) does not take place, an additional metal post (45) is provided, preferably not fixed to the folded rail (1'"), inserted in the ground via the interior surface of the hook-shaped end stop (44), which increases the capacity of the ground for resistance inside said end stop (44).

I claim:

1. A mixed wooden and metallic road safety barrier comprising at least a succession of stretches of horizontal rails, said stretches having their adjacent ends sections very close, each adjacent end sections supported together, via a distance spacer, by a vertical post, each stretch of the horizontal rail made up of at least two wooden logs fitted on a common metallic profile, said wooden logs having their adjacent ends sections very close each other, said adjacent ends having a vertical slot, said adjacent ends connected together via a metal connection plate housed in said vertical slots of adjacent wooden logs, said metal attachment plate being further attached to each adjacent log and the common metallic profile.

2. A mixed wooden and metallic road safety barrier according to claim 1, wherein said vertical posts are covered by a wooden cover comprising at least three flat wooden strips covering the front face and the two lateral faces of said vertical post, said wooden strips being joined together by means of fastening selected from the group consisting of pins, screws, bolts, nails, staples and gluing.

3. A mixed wooden and metallic road safety barrier according to claim 1, wherein said succession of stretches of horizontal rails having at least an end-section, said end-section being a folded rail towards ground level, said folded rail being supported by at least a metallic posts, being the lower end of the folded rail buried in the ground, being said buried end of the folded rail attached to a metal stop piece in the form of a hook, and said buried end comprising a metallic post inserted vertically in the ground through the interior surface of the hook-shaped piece.

4. A mixed wooden and metallic road safety barrier according to claim 1, wherein said distance spacer comprises:

a main metallic body made of a profile of constant cross-section with its longitudinal axis in the direction of the barrier, presenting a straight cross-section in the form of an Greek letter omega comprising two flanges (upper and lower) for linking and holding two metallic profile of two adjacent stretches of the horizontal rail, a central core having at least a window and two wings, each wing connecting a flange with the central core, and an interior metallic piece placed between said wings presenting the form of a faceplate and having at least a start-shape hole comprising a central opening and a series of slots of length greater than their thickness in radial configuration arranged, and connected, around said central opening, said start-shape hole facing said window of the central core of the main body;

whereby said start-shape hole and window receives an attachment screw with a head and a stem so that the main body and the interior piece are joined together to form a single body and said attachment screw links the metallic support to the vertical post, and whereby the diameter of said central opening of the start-shape hole being shorter than the diameter of the head of the attachment screw, and being the diameter of the head of the attachment screw shorter than the diameter or side of the window of the central core of the main body.

5. A mixed wooden and metallic road safety barrier according to claim 4, wherein a flat metallic plate is provided between the central core of the main body of the metallic support and the vertical post.

6. A mixed wooden and metallic road safety barrier according to claim 5, wherein said metallic plate is extended towards the ground supporting a horizontal and longitudinally continuous screen located beneath the horizontal rails.

* * * * *